US005333771A

United States Patent [19]

Cesario

[11] Patent Number: 5,333,771

[45] Date of Patent: Aug. 2, 1994

[54] WEB THREADER HAVING AN ENDLESS BELT FORMED FROM A THIN METAL STRIP

[75] Inventor: Donald C. Cesario, Green Bay, Wis.

[73] Assignee: Advance Systems, Inc., Green Bay, Wis.

[21] Appl. No.: 93,530

[22] Filed: Jul. 19, 1993

[51] Int. Cl.[5] ..... B65H 20/16

[52] U.S. Cl. ..... 226/92; 34/120; 34/646; 34/658

[58] Field of Search ..... 226/92; 198/834, 810, 198/803.15; 34/120, 158, 162, 163; 101/228; 162/193

[56] References Cited

U.S. PATENT DOCUMENTS

| | | | |
|---|---|---|---|
| 495,244 | 4/1893 | Dixon . | |
| 811,307 | 1/1906 | Lorimer . | |
| 1,983,264 | 12/1934 | Belcher . | |
| 2,101,335 | 12/1937 | Jennings et al. . | |
| 2,265,313 | 12/1941 | Ridley . | |
| 2,788,841 | 4/1957 | Hockett . | |
| 2,862,705 | 12/1958 | Faeber | 34/120 |
| 3,149,003 | 9/1964 | Christie et al. . | |
| 3,237,316 | 3/1966 | Sachs . | |
| 3,252,691 | 5/1966 | Getzin et al. . | |
| 3,265,267 | 8/1966 | Wallin . | |
| 3,387,779 | 6/1968 | Steffens . | |
| 3,399,465 | 9/1968 | Lanne et al. . | |
| 3,618,564 | 11/1971 | Dungs | 118/66 |
| 3,758,960 | 9/1973 | McCreary et al. . | |
| 3,759,434 | 9/1973 | Lindstrum et al. . | |
| 4,007,585 | 2/1977 | Vossen . | |
| 4,137,648 | 2/1979 | Rhodes . | |
| 4,485,125 | 11/1984 | Izu et al. | 427/74 |
| 4,501,072 | 2/1985 | Jacobi, Jr. et al. . | |
| 4,543,160 | 8/1988 | Kerttula et al. . | |
| 4,767,042 | 8/1988 | Daane . | |
| 4,768,695 | 9/1988 | Stibbe . | |
| 4,833,794 | 5/1989 | Stibbe et al. . | |
| 4,897,015 | 1/1990 | Abbe et al. | 414/744.8 |
| 5,121,560 | 6/1992 | Daane et al. . | |
| 5,134,788 | 8/1992 | Stibbe et al. . | |
| 5,158,410 | 10/1992 | Hunt | 198/803.15 X |
| 5,249,373 | 10/1993 | Rogne et al. | 34/120 |
| 5,255,602 | 10/1993 | Mamberer et al. | 226/92 X |
| 5,259,496 | 11/1993 | Common | 198/803.15 |

*Primary Examiner*—Andrew M. Falik
*Attorney, Agent, or Firm*—Nilles & Nilles

[57] ABSTRACT

A web threader assembly comprises at least one flexible stainless steel belt to which the leading edge of a web can be detachably affixed. The belt is conveyed through a web path extending through the dryer or other machine in which the web travels, is guided by a plurality of pulleys and tensioning devices, and is positively driven through the dryer or other web processing machine by its own drive system. The belt is extremely thin and thus permits tight sealing of the dryer or other machine requiring a threading operation and also requires no lubrication, and also can be easily cleaned and thus can be used in sterile environments. If the threader is to be used with a relatively wide web, two spaced apart belts are preferably provided and connected threader bar to which the web is attached. An electronic control system monitors operation of the threader assembly and terminates operation of the threader assembly upon breakage or jamming of the web or the belt.

31 Claims, 16 Drawing Sheets

WEB THREADER HAVING AN ENDLESS BELT FORMED FROM A THIN METAL STRIP

BACKGROUND OF THE INVENTION

1. Field of the Invention

The invention relates to web handling systems and, more particularly, relates to a system for threading endless webs through a machine such as a dryer.

2. Description of the Related Art

In a variety of applications, a continuous web formed from paper, film, foil, or other materials is fed through a machine such as a dryer in which an operation such as drying is performed on the web. The web is typically pulled through the dryer or other machine during operation of the machine by pulleys or other devices located outside cf the machine. However, during start up of the machine, the web must be threaded through the machine by an internal threader assembly.

The typical threader assembly comprises a belt or a chain which grasps an edge of the web and which pulls the web through the machine to thread the web. One such machine is disclosed in U.S. Pat. No. 3,399,465, which issued to Lanne et al. on Sep. 3, 1968. The web threader disclosed in Lanne et al. includes an endless conveyor composed of two substantially planer belts which are united at their outer lateral edges and which are bent over one another as they travel through a dryer to enclose the leading end of the web material therebetween. The two parts are separated at the outlet of the dryer to release the web.

The web threader disclosed by Lanne et al., as well as other web threaders which were heretofore available, suffer from several drawbacks and disadvantages. First, rubber or canvas belt-type threaders of the type disclosed in Lanne et al. are difficult to clean, cannot withstand high temperatures which may be present in some dryers, and may be susceptible to attack by solvents present in many devices in which threaders are employed. Such solvents are often present in high concentrations in dryers which handle solvent-laden paper. Moreover, the overlapping belt-type threader disclosed by Lanne et al. also is necessarily relatively thick and thus cannot be used on equipment requiring very tight sealing, such as inert atmosphere enclosures in which an inert gas such as nitrogen is induced to reduce oxygen levels, thus inhibiting combustion. The typical threader also obstructs the viewing area located above the web, thereby inhibiting visual monitoring of the threader operation. Because the belt-type threader disclosed by Lanne et al. necessarily touches the top of the web, it cannot be used to thread webs having a wet coating on the entire widths of their upper or lower faces without smudging or smearing the coating.

Some of the disadvantages associated with belt-type threaders can be avoided through the use of chain-type threaders which grasp the edges of the webs. For instance, chain-type threaders are less susceptible to corrosion from solvents and are more suitable for higher temperature applications. However, such threaders have limited flexibility and are also relatively bulky and difficult to clean, thus limiting their suitability for use in equipment requiring tight sealing or in configurations requiring the conveying of the webs through complex paths. These chains are also relatively heavy and thus can span only relatively short distances without supports. Chain-type conveyors also usually require lubrication and thus cannot be used in applications requiring extreme cleanliness.

OBJECTS AND SUMMARY OF THE INVENTION

It is therefore an object of the invention to provide a threader assembly, for pulling the leading edge of a paper web or the like through a machine such as a dryer, which is extremely thin and flexible and which can thus be used in machines requiring tight sealing and/or requiring that the webs be conveyed through a complex path or a narrow space.

Another object of the invention is to provide a web threader assembly which can be easily cleaned and thus which can be used in applications requiring extreme cleanliness.

Still another object of the invention is to provide a web threader assembly which can withstand extremely high temperatures and which resists corrosion.

Still another object of the invention is to provide a web threader assembly which is reversible.

According to one aspect of the invention, these objects are achieved by providing a web threader assembly which includes an endless threader belt, extending along the web path, to which the leading edge is detachably affixed. The belt is preferably comprised of a thin strip of flexible stainless steel having perforations evenly spaced along its length. Guide means are preferably provided for guiding the belt along the web path, along with a sprocket having protrusions which engage the perforations. Driver means may also be provided for driving the sprocket such that the sprocket drives the belt through the dryer along the web path and carries the web therewith. The thin stainless steel belt is easily cleaned, resists corrosion, and is strong yet flexible. Positive drive devices such as a sprocket drive permit reversal of the web threader assembly.

If relatively wide webs are to be threaded, a threader bar is preferably attached to opposed belts, and the leading edge of the web attached to the threader bar. The threader bar may have rollers or other guide devices provided on its ends, in which case channel means will be provided for guiding the threader bar along the web path, the channel means engaging the ends of the threader bar. To facilitate assembly and disassembly, each of the ends may further comprise a hollow tube which is slitted to receive the endless threader belt, and a segmented shaft at least partially disposed in the hollow tube. The segmented shaft comprises first and second sections which receive the belt therebetween. Each of the ends further comprise a pin which extends from the first section, through one of the perforations in the belt, and into the second section.

Alternatively, if a non-detachable threader bar is required, the threader bar may be include a pair of plates, each of which is attached to one of the belts, and a rod connecting the plates to one another.

Yet another object of the invention is to provide a web dryer having a novel web threader assembly provided therein.

In accordance with this aspect of the invention, the dryer includes an inlet, an outlet, two sides, a web path extending between the sides and inside the dryer from the inlet to the outlet, a plurality of air bars positioned above and below the web path, and a threader assembly for threading a web, having a leading edge, through the dryer, the threader assembly being constructed as described above in connection with the first aspect of the invention.

The dryer may comprise a two-section dryer having first and second sections stacked one on top of the other. Each of the first and second sections have a respective first, stationary portion and a second portion which is positioned on top of the first portion and which is raisable from a first position in which the second portion is in close proximity to the first portion to a second position in which the second portion of the second section. A plurality of seals seal the second portion of the second section with respect to the first portion when the second portion is in the first position.

Yet another object of the invention is to provide a system for controlling the operation of a web threader assembly so as to detect and to react to breakage or misfeed of the web or failure of the web threader, and to control initiation and termination of a web threading operation.

In accordance with this aspect of the invention, the electronic control circuit includes means for actuating the drive device to drive the belt in a forward direction, means for monitoring operation of the web threader and for generating a signal upon detection of a threader fault, and means, responsive to the means for monitoring, for disabling the drive device upon detection of a threader fault.

The means for monitoring preferably includes a zero speed switch which monitors movement of the belt and which generates a signal when the speed of the belt is below a predetermined value. If such a switch is provided, a timer should also be provided which disables the zero speed switch during start-up of the drive device so that the belt reaches a minimum normal operating speed before the zero speed switch begins to monitor movement of the belt. The means for monitoring may additionally include a load detector which detects current drawn by an electric motor serving as the drive device and which generates a signal when an increase in drawn current is detected which is representative of a load on the motor caused by a web jam.

The means for disabling preferably comprises a latch relay which is connected to the means for monitoring and which deactivates the drive device upon generation of the fault signal. In this case, a manually operated reset switch is connected to the latch relay and, when actuated, resets the latch relay to re-enable operation of the drive device.

Other objects, features, and advantages of the present invention will become apparent to those skilled in the art from the following detailed description. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being made to the accompanying drawings in which like referenced numerals represent like parts throughout, and in which.

DETAILED DESCRIPTION OF THE PREFERRED EMBODIMENTS RESUME

Figure 1:
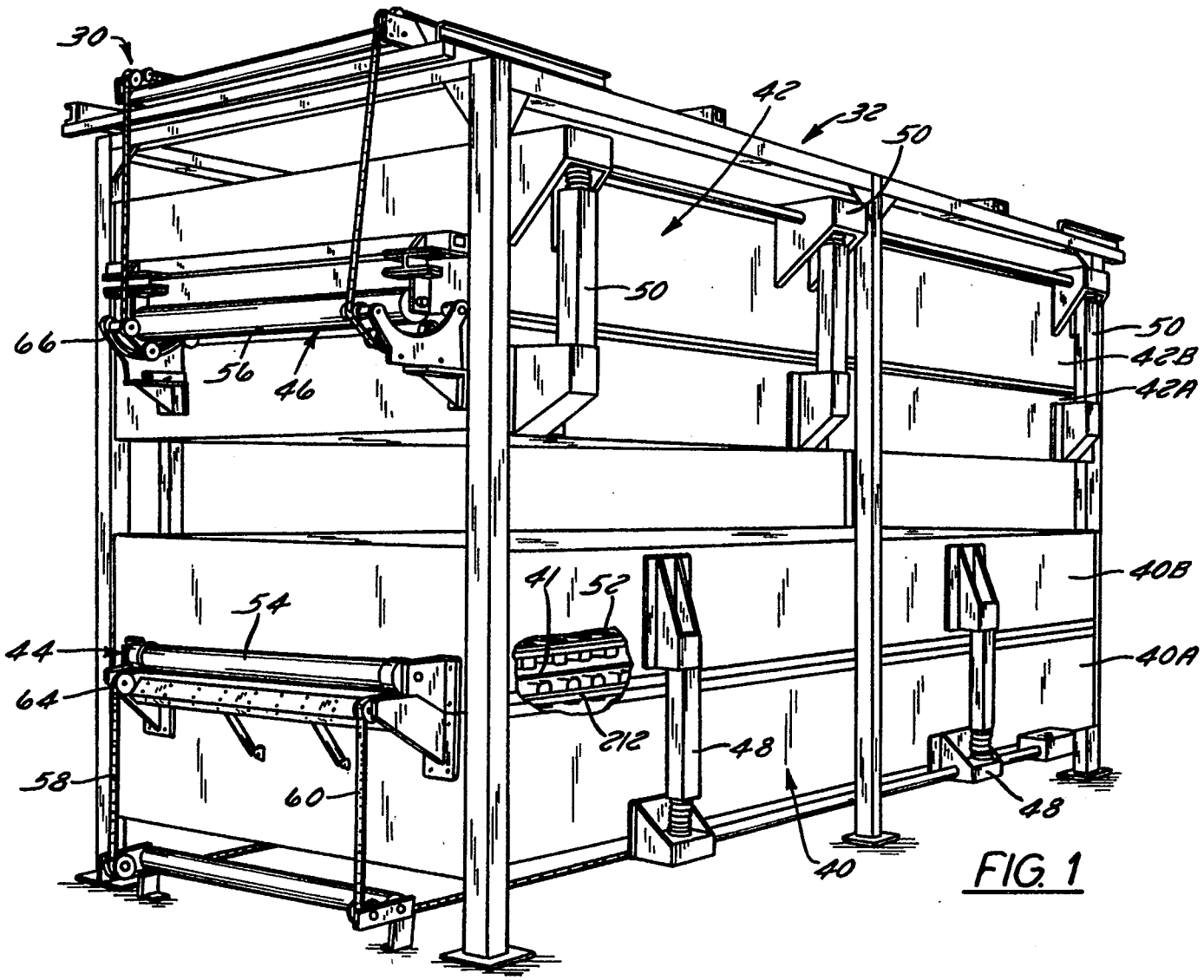
FIG. 1 is a perspective view of a web dryer and threader assembly constructed in accordance with a preferred embodiment of the invention.

Pursuant to the invention, a web threader assembly is provided which comprises at least one flexible stainless steel belt to which the leading edge of the web can be detachably affixed. The belt is conveyed through a web path extending the length of the dryer or other machine in which the web travels, is guided by a plurality of pulleys and tensioning devices located outside or inside of the dryer equipment, and is positively driven through the dryer or other machine by its own drive system.

The belt is extremely thin and thus permits tight sealing of the dryer or other machine requiring a threading operation and also requires no lubrication, and also can be easily cleaned and thus can be used in sterile environments. If the threader is to be used with a relatively wide web, two spaced belts are preferably provided and connected to a threader bar to which the web is attached. Depending upon the flexibility requirements of a particular system, the threader bar may be guided only by the stainless steel belts or may include rollers which are guided through the dryer or other machine by suitable guides. An electronic control system monitors operation of the threader assembly and terminates operation of the threader assembly upon breakage or jamming of the web or the belt.

System Overview

Referring now to FIGS. 1–6, a web threader assembly constructed in accordance with a preferred embodiment of the invention is provided in a dryer assembly 32. The dryer assembly 32 receives a continuous web 34 from a coater or similar device and dries the web as it is conveyed along a web path extending through the assembly 32.

The dryer assembly 32 is merely representative of a machine in which a threader constructed in accordance with the invention could be employed. It should be understood that the threader assembly 30 could actually be used in any enclosed machine through which a web is conveyed. However, threader assemblies constructed in accordance with the present invention are especially well suited for dryers or ovens because they can withstand high temperatures, are extremely thin so as to permit tight sealing of the dryers and are not subject to corrosion from water and chemicals present in dryers. Tight sealing is particularly important in dryers using an inert atmosphere wherein nitrogen is used to reduce oxygen levels in one or more sections of the dryer. Web threader 30 could be installed during construction of dryer 32 or could be retrofit into an existing dryer.

Dryer assembly 32 could be of any conventional configuration but, in the illustrated embodiment, is a two-pass dryer having upper and lower sections 40 and 42 each having a web path 41, 43 extending between lower portions 40A, 42A and upper portions 40B, 42B thereof. Lower section 40 includes a so-called inert atmosphere enclosure which is sealed during both web threading and drying operations. Upper section 42 is a more conventional section having an ambient internal atmosphere and thus lacking the inert seals. Of course, any combination of inert and ambient atmosphere enclosures could be employed, if desired. Each of the sections 40 and 42 is closed during normal operation of the dryer and the threading operation but may be opened if required via operation of the respective screwjacks and motor arrangements 48 and 50.

The threader assembly 30 conveys the leading edge 35 of the web 34 through an inlet 44 formed in the front of the web path 41 extending through the first section 40 of the dryer assembly 32, through the first and second sections and 42, out of an outlet 46 formed in the front end of the second dryer section 42, and over and to the rear end of dryer section 42. Depending on the requirements of a particular system, the web 34 could also be conveyed through the first section 40 or could bypass the dryer altogether in the manner discussed in more detail below. The web 34 is dried by a plurality of staggered air bars 52 positioned above and below the web paths 41, 43 and extending along the width of the paths. These air bars can be retracted by internal retraction devices such as pneumatic cylinders or screw jacks to permit a web threading operation.

The construction and operation of the dryer assembly 32 including the air bars 52 but excluding the threader assembly 30 are, per se, well known and are described, e.g. in U.S. Pat. Nos. 5,134,788: 4,833,794; 4,768,695; and 4,767,042, the disclosures of which are hereby incorporated by reference.

Construction of Belts and Belt Drive System

Referring to FIGS. 1–21, the web threader assembly 30 includes a pair of endless stainless steel belts 58 and 60 conveyed through the dryer sections 40 and 42 along the web paths 41, 43 by a common drive system 62. The belts 58 and 60 are guided through the inlet and outlets 44 and 46 of the dryer sections 40 and 42 by respective web seals and web guide assemblies 64 and 66 and through the dryer sections 40 and 42 by a plurality of guide pulley assemblies located outside of the dryer. In the illustrated embodiment, the leading edge 35 of the web 34 is drawn through the dryer sections 40 and 42 during a threading operation by a threader bar assembly 68.

Each of the belts 58 and 60 is of identical construction. Accordingly, only the right belt 60 will be described in detail. Belt 60 is formed from a continuous flexible metal strip. Although various materials could be used for the belt 60, stainless steel is preferred because it is relatively strong yet flexible, is easy to clean, can withstand high temperatures, and resists corrosion either by water or by V.O.C. (volatile organic compound) solvents. The high strength of the metal belt permits the use of an extremely thin belt, i.e., on the order of 0.010 of an inch in thickness. Because the belt is formed from a continuous strip and thus has no relatively movable parts, it requires no lubrication and thus can be used in sterile environments. The belt 60 is approximately 1.5" wide and has a plurality of holes 70 formed therein for engagement with the drive system discussed in more detail below.

It should be noted at this point that only a single belt could be used to thread a relatively narrow web through a dryer or other machine. In this case, the belt would be positioned along one side of the web such that the side edge of the leading edge of the web is taped or otherwise affixed to the belt or to a device attached to the belt. However, because the illustrated threader assembly is designed to thread relatively wide webs and thus requires the employment of two belts, the drive system 62 must be designed so as to assuredly convey both belts 58 and 60 through the dryer at the same speed so as to avoid twisting of the belts or web. To this end, referring to FIGS. 6–11, the drive system 62 is positively coupled to each of the belt 58 and 60.

Drive system 62 includes a drive device such as a suitable AC or DC electric motor 72 or a manually driven device such as a crank. First and second sprockets 74 and 76 drive the respective belts 58 and 60 and are driven by a rigid shaft 78 connected to the motor 72 or other drive device by a coupling and gear reducer 80. Each of the sprockets 74 and 76 is of identical construction and cooperates with identical tensioning and guide assemblies of the drive system 62. Accordingly, only the sprocket 76 and its associated guide and tensioning system will be described.

Sprocket 76 has a central bore 77 which may be keyed or otherwise connected to shaft 78. A plurality of teeth or protrusions 82 are formed on the central portion 83 of the peripheral surface 84 of sprocket 76. These teeth or protrusions are spaced apart from one another along surface 84 by a distance equal to that between the holes 70 of belt 60 and engage these holes to drive the belt. Other devices, such as friction drives, could be used in place of sprockets 74, 76, thus obviating the need for holes 70 in belts 58 and 60.

To prevent slippage of the belt 60 with respect to the sprocket 76, the belt is guided into contact with the sprocket 76 and tensioned into engagement therewith by a sprocket friction means including a plurality of idler or guide pulleys 85–87 and tensioning pulleys 88 and 89. The positions of the tensioning pulleys 88 and 89 can be adjusted, e.g., in the case of pulley 88, by adjusting the position of pulley 88 on rod 88A, so as to assure adequate tension of the belt 60 on the drive sprocket 76. Providing a separate tensioning pulley on each side of the sprocket enables the threader to be reversed without slippage. The disclosed drive system including an electric motor and positive drives such as sprockets 74 and 76 also permits the belts 58 and 60 to be driven at variable speeds.

Description of Guide Assemblies

The web threader assembly 30 also includes several guide pulley assemblies which guide the belts 58 and 60 into the inlet 44 of dryer section 40, through the dryer sections 40 and 42, and out of outlet 46 of the dryer section 42. These assemblies also act as slack tensioner means for maintaining the belts taut and include the web seals and web guide assemblies 64 and 66, lower guide pulley and tensioner assemblies 91–95 (FIG. 5), upper guide pulley assemblies 96–98, and corners 98 and 99. Further guide pulleys are positioned at the outlet and inlet of the first and second dryer sections 40 and 42, respectively. Because the belts 58 and 60 are much lighter than conventional chain or belt assemblies they require fewer support or guide devices inside the dryer. This saves considerable space and facilitates sealing of the dryer. Although the following paragraphs describe in more detail the preferred construction of some of these guide assemblies, any suitable assemblies could be used so long as the guide assemblies guide the belts 58 and 60 and the web 34 through the dryer without binding and without contacting the web.

Referring to FIGS. 1–6, web entrance seal assembly 64 includes a pair of flanged pulleys 100 and 101 which engage the respective left and right belts 58 and 60 and which are mounted on respective support plates 102 and 104 which are in turn mounted onto the front wall 106 of the lower dryer section 40. A rectangular seal frame 108 is pivotally mounted at its bottom rear corners to the brackets 102 and 104 by respective pivot pins 110 so as to be closed seal the inlet of section 40 during normal drying and to open to permit passage of a threader bar during initiation of a web threading operation. Each of a pair of piston and cylinder arrangements 114, 116 includes a respective cylinder 118, 120 pivotally mounted on the front wall 106 of dryer section 40, and a piston 122, 124 extending out of the cylinder 118 and 120 and pivotally connected to a respective bracket 126 and 128 mounted on the bottom front corner of the seal frame 108. A metallic plate 130 is mounted on the top surface of seal frame 108 and is pivotable upon actuation of piston cylinder assemblies 114 and 116 to a position immediately below inlet roller 54 for web 34.

Figure 2:
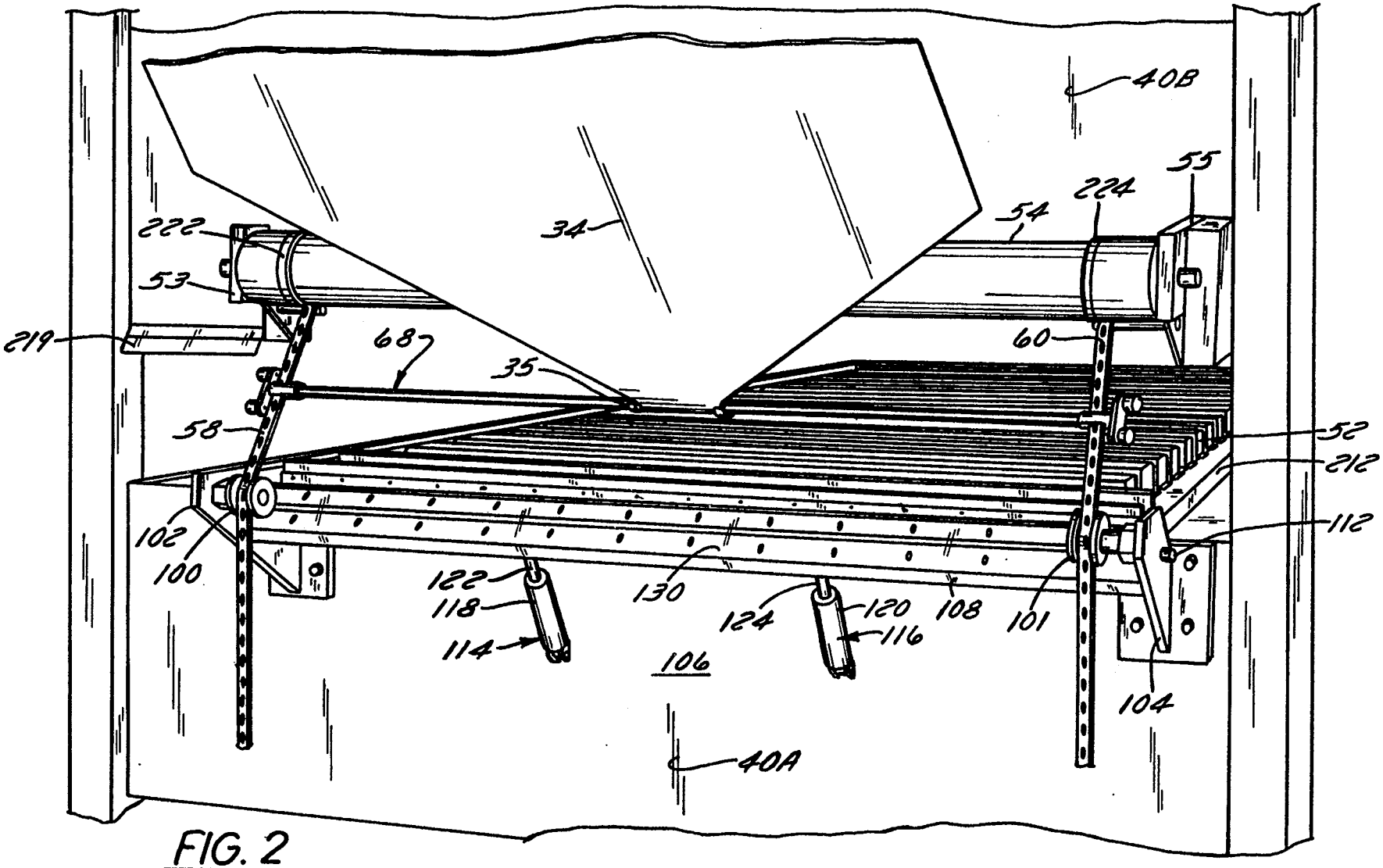
FIG. 2 is a perspective view of a portion of the assembly of FIG. 1 illustrating a web threading operation shown with dryer enclosure open.
Figure 3:
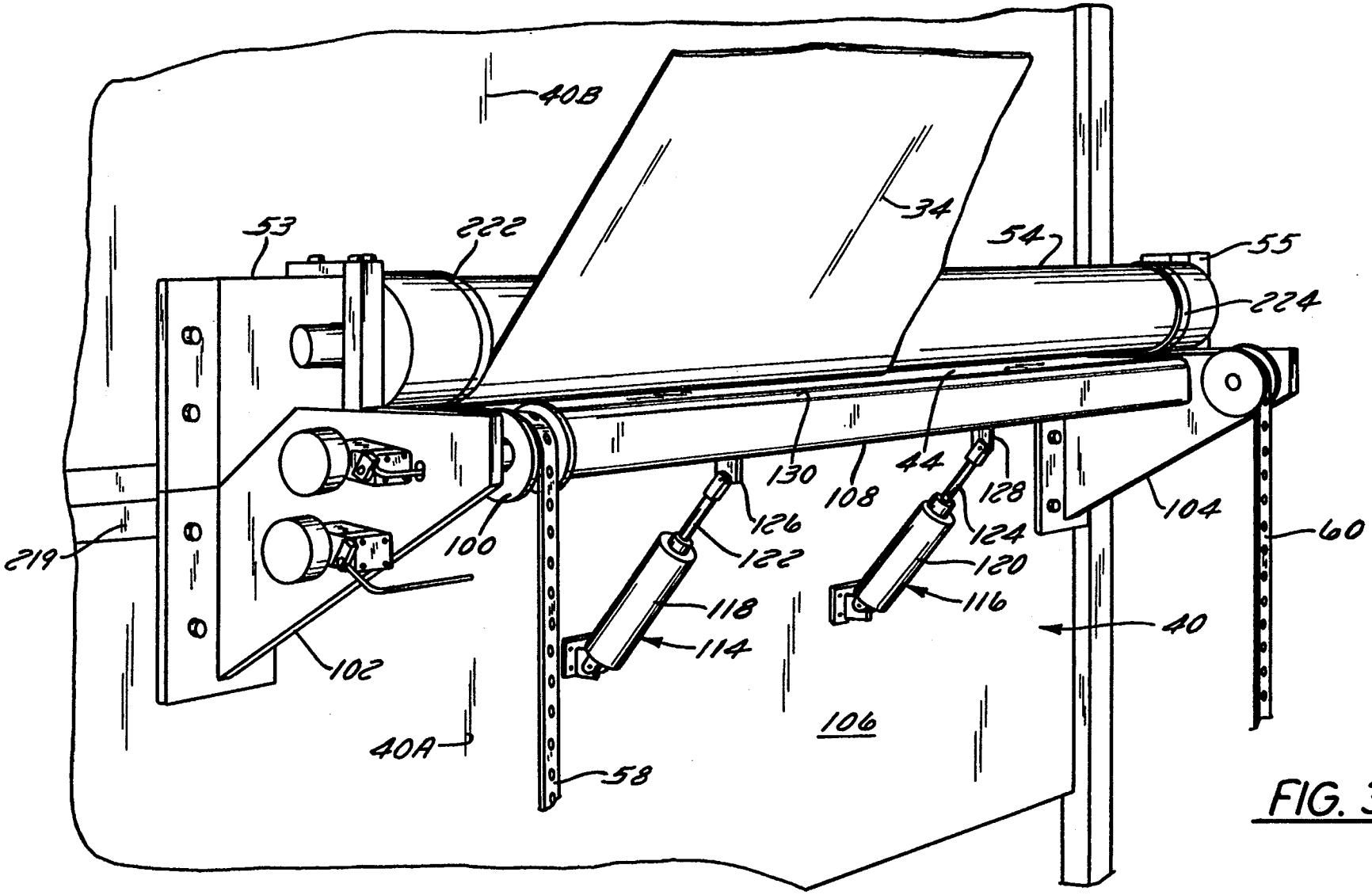
FIG. 3 is a perspective view of a portion of the assembly of FIG. 1 illustrating a dryer threading.
Figure 4:
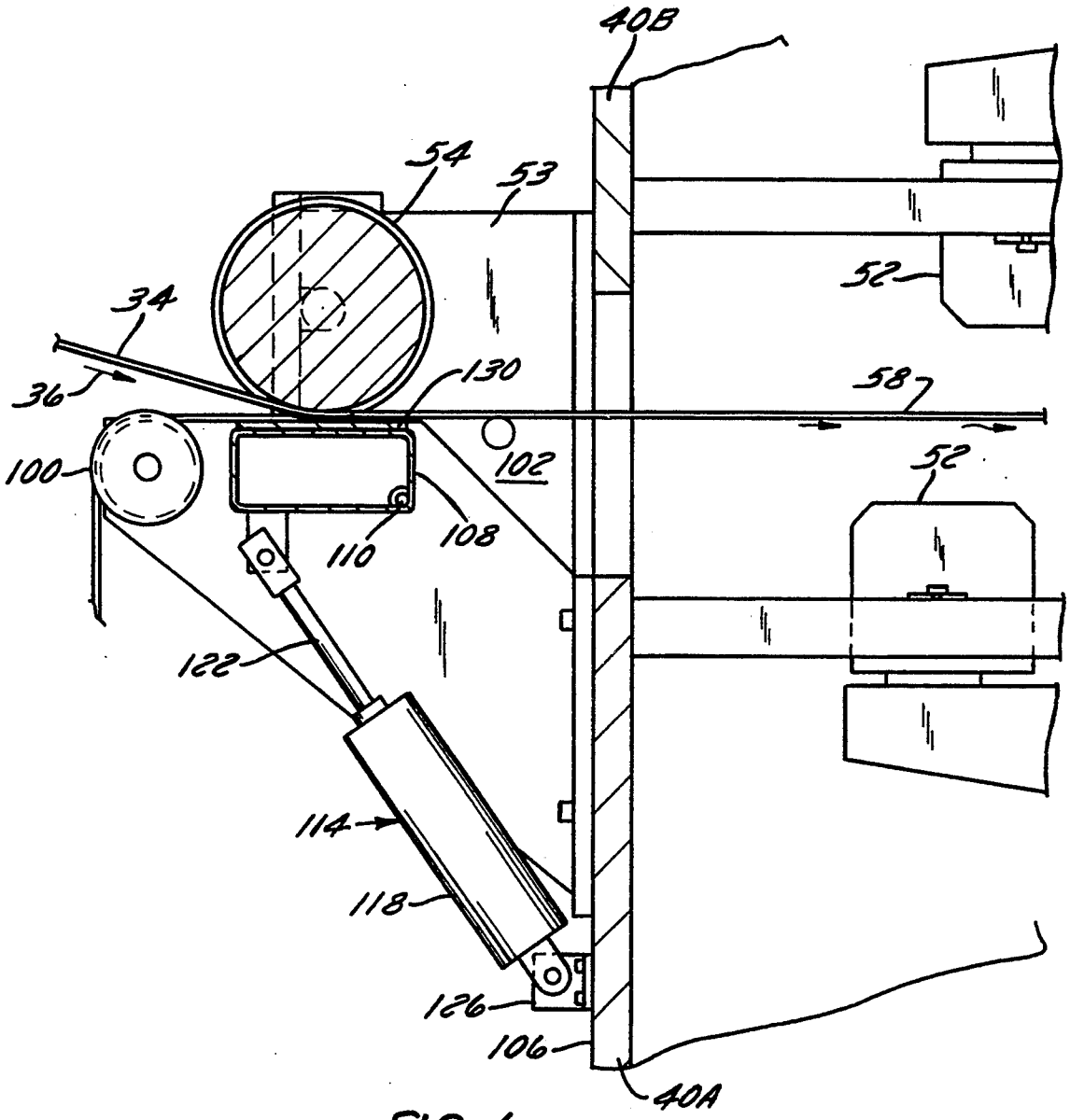
FIG. 4 is sectional elevation view of a portion of the assembly of FIG. 1 illustrating a dryer threading.

The piston and cylinder arrangements 114 and 116 are typically actuated to their retracted position illustrated in FIG. 2 during a web threading operation and to their extended positions illustrated in FIGS. 3 and 4 during a drying operation. By pivoting the seal frame 108 in this manner, web threading is facilitated while simultaneously permitting a relatively tight seal between the plate 130 and the seal roller 54 during normal operation of the dryer.

Figure 13:
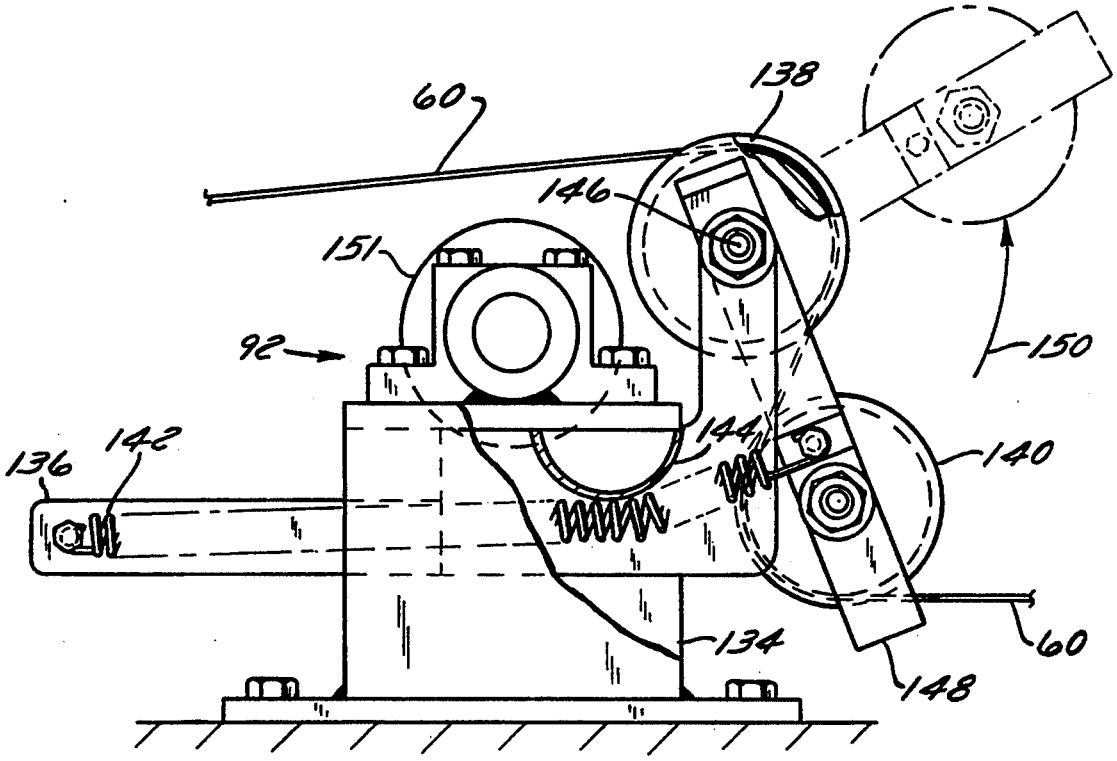
FIGS. 13 and 14 are side elevation and perspective views of a lower guide pulley and threader belt tensioner assembly of FIG. 5.
Figure 14:
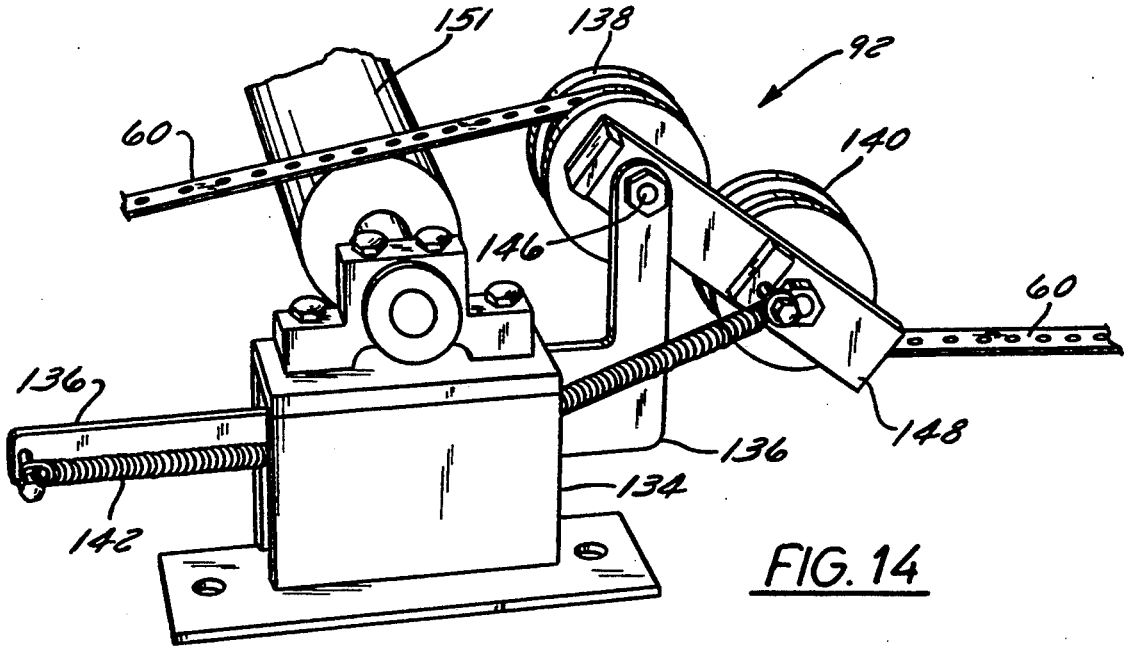

Each of the lower guide pulley and threader belt tensioner assemblies 91–95 is of identical construction, with alternate assemblies tensioning alternate sides of belt 60. To avoid repetition, only assembly 92 will be described. Referring to FIGS. 13 and 14, lower assembly 92 includes a hollow pedestal frame 134, an L-bracket 136 fixed to the frame, first and second flanged pulleys 138 and 140, a spring 142, and a spring guide 144. First pulley 138 is rotatably fixed to the upper leg of L-bracket 136 by a suitable shoulder bolt 146. Bolt 146 also pivotally supports a bracket 148 on which the second pulley 140 is rotatably mounted. Belt 60 travels over the first pulley 138 and under the second pulley 140 during normal operation of the threader assembly, thus tending to pivot the bracket 148 and the pulley 140 about the bolt 146 in the direction of arrow 150 in FIG. 13. This pivoting is prevented or at least inhibited by spring 142 which is sufficiently stiff to tension the belt 60 against the tensioning force imposed on the belt, as illustrated in FIG. 14, thus pulling the belt taut. Kinking of the spring 142 upon pivoting of bracket 148 is prevented by contact with arcuate spring guide 144.

Figure 14A:
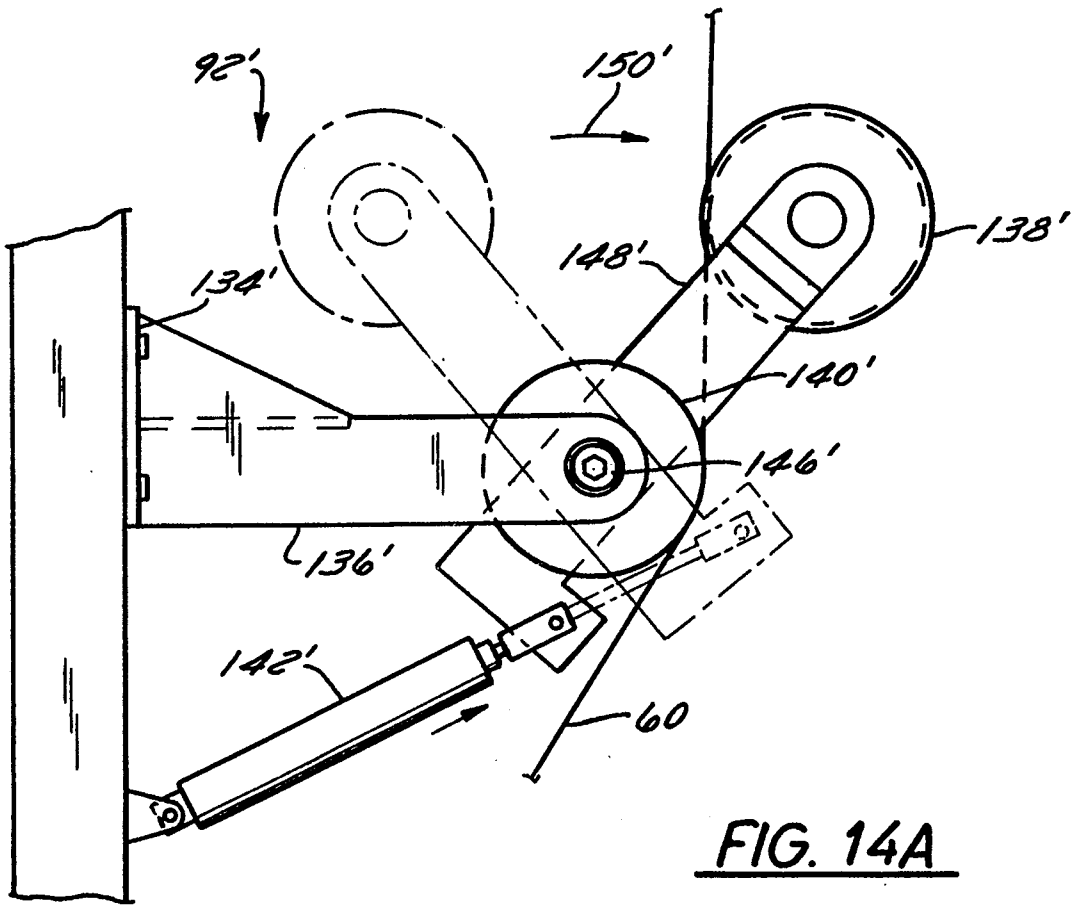
FIG. 14*a* is an elevation view of an alternate guide pulley and threader belt tensioner assembly.
Figure 15:
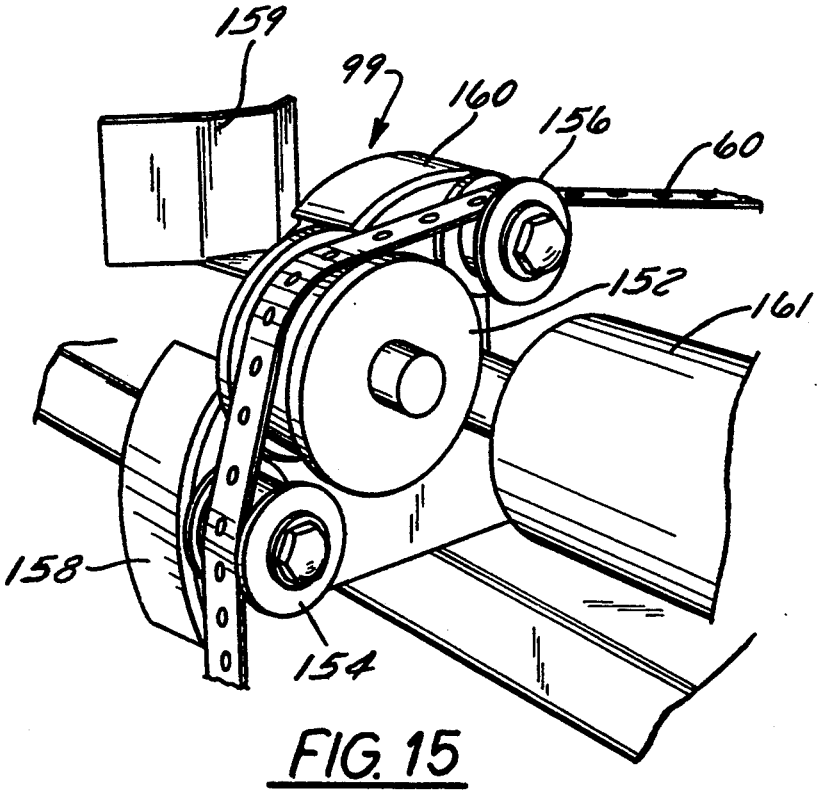
FIG. 15 is a perspective view of a corner guide pulley assembly of FIG. 5.

Referring to FIG. 14A, a standard guide pulley and threader belt tensioner assembly 92' with pneumatic loading could be used in place of the spring-type tensioner assembly 92. Tensioner assembly 92' includes a frame 143' on which is immovably mounted a bracket or bar 136'. First and second flanged pulleys 138' and 140' are rotatably mounted on a second bracket 148' which is in turn pivotally mounted on the bracket 136' via a bolt 146 which also rotatabiy supports pulley 140'. The belt (not shown) travels between the first pulley 138' and the second pulley 140' during normal operation of the threader assembly, thus tending to pivot the bracket 148' in the direction of arrow 150'. This pivoting is prevented or at least inhibited by a pneumatic cylinder 142' which is connected to bracket 148' and the degree of actuation of which determines the tension imposed on the belt. As the pneumatic cylinder 142' extends, pulley 138 and bracket 148 move towards the position illustrated in phantom lines in FIG. 14A.

Roller 151 may receive a web if the web is to bypass the dryer altogether. In this case, the web will be transported over the rollers of each of the guide assemblies 91–95 and pulled underneath the dryer.

Each of the corner guide pulley assemblies 98 and 100 is of identical construction. Accordingly, only corner guide pulley assembly 98 will be described with reference to FIG. 15. Guide assembly 98 includes a flanged support pulley 152 and flanged guide pulleys 154 and 156 located upstream and downstream of support pulley 152. This system of pulleys guides the belt 60 through a turn of at least 90° while preventing the belt from kinking or binding. Each assembly 98 and 100 additionally includes a roller 161 which guides a web over the top of the dryer in a manner discussed in more detail below. Guide strips 158–160 guide the rollers or idler wheels of the threader bar assembly around the corner as discussed in more detail below.

Figure 16:
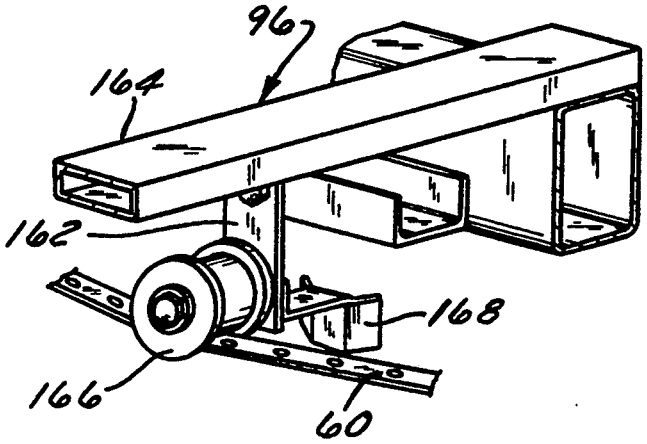
FIG. 16 is a perspective view of an upper belt guide pulley assembly of FIG. 5.
Figures 17, 18:
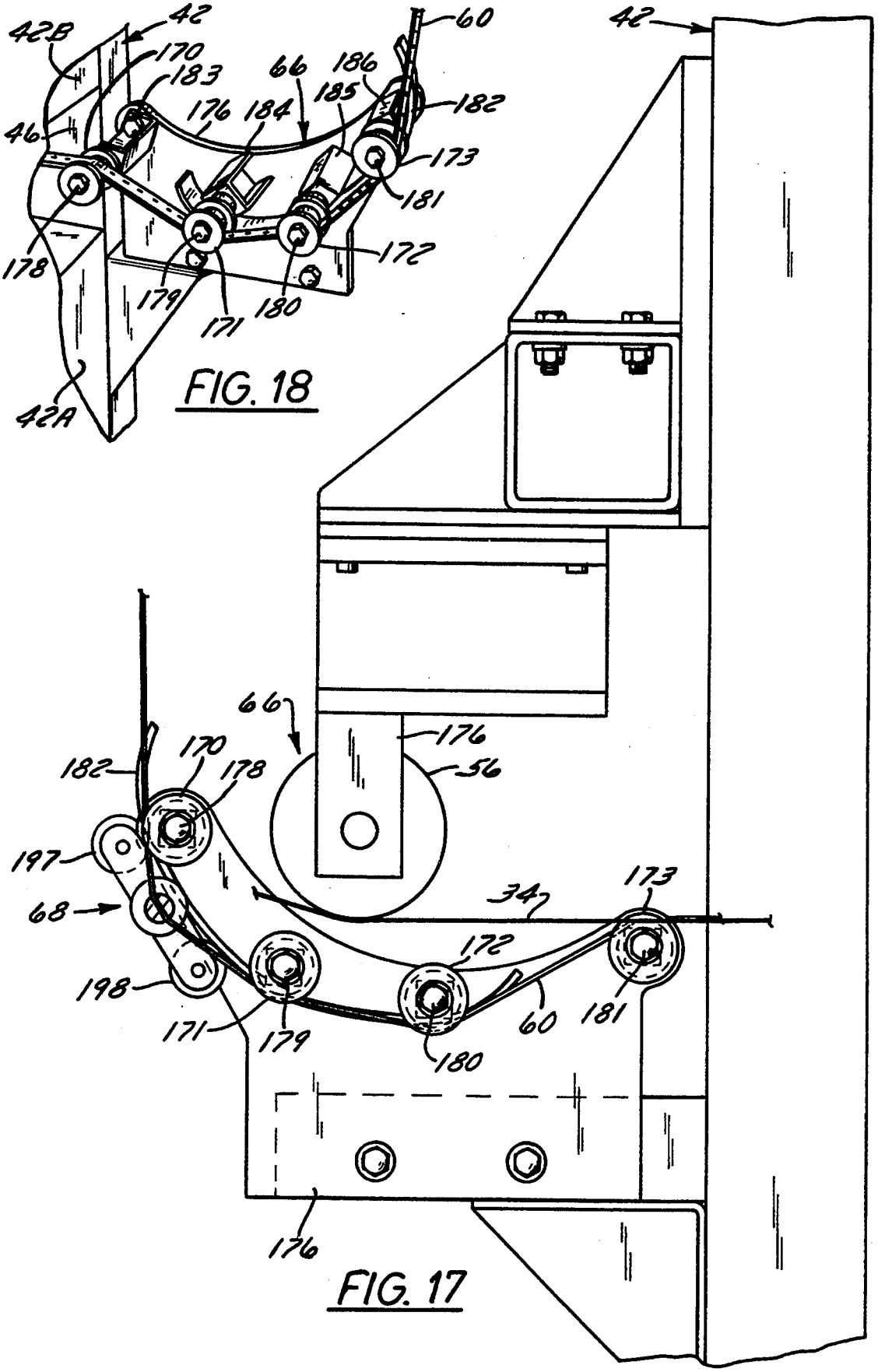
FIGS. 17 and 18 are side elevation and perspective views respectively, of the web transference around web steering unit of FIG. 5.

Each of the upper guide pulley assemblies 95–97 is relatively simple in construction and, referring to FIG. 16, includes a bracket 162 mounted on a support beam 164, and a flanged pulley 166 and a guide strip 168 mounted on the bracket 162. It should be noted that the pulleys 166 of alternate assemblies 95–97 contact opposite faces of the belt 60, thus assuring adequate tensioning of the belt 60.

Referring now to FIGS. 1–6, 17 and 18, the web guide assembly 66 is designed to guide the belt 60 through an angle of 90° while simultaneously guiding the web 34 cut of the outlet 46 of dryer section 42 and around the web guide without interference from the belt. In the illustrated embodiment, this is achieved by guiding the belt 60 around a plurality of flanged pulleys 170–173 so as to separate the belt 60 from the web guide roller 56 for the web 34. Each of the flanged pulleys 170–173 is rotatably mounted on a support plate 176 by a respective rod 178–181. The rollers or idler wheels of a threader bar assembly are guided out of outlet 46 by a guide strip 182 mounted adjacent pulleys 170–173. In the illustrated embodiment, each of the rods 178 through 181 is mounted on a respective support 183–186 which is in turn mounted on support plate 176. The illustrated mounting arrangement could of course be replaced by any other suitable arrangement.

Construction of Threader Bar Assembly

The threader bar assembly 68 is designed to be supported by the belts 58 and 60 and to pull the web 34 through the dryer sections 40 and 42 during a threading operation. Assembly 68 is also preferably designed for easy attachment to and detachment from the belts 58 and 60 and to be guided through the web travel path.

Figure 21:
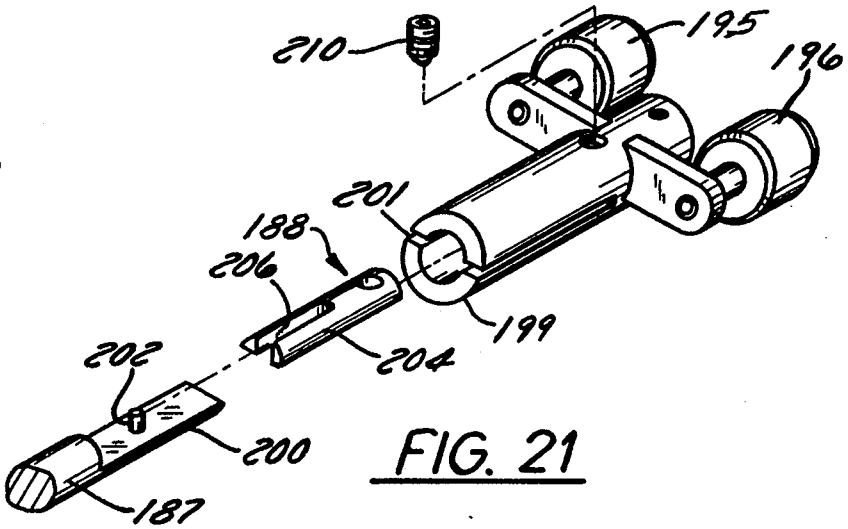
FIG. 21 is an exploded perspective view of a portion of the threader bar assembly illustrated in FIGS. 19 and 20.
Figure 20:
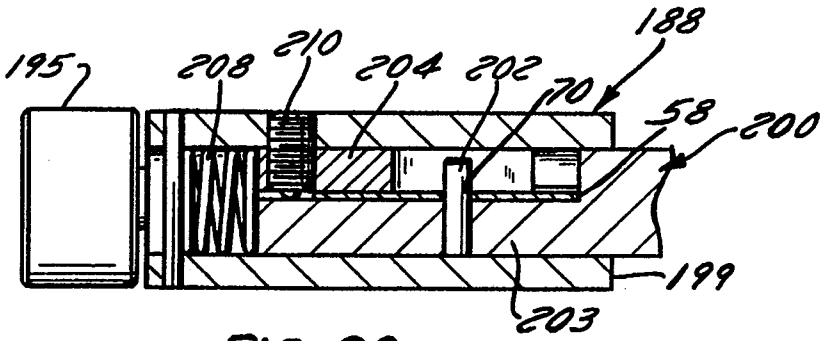
FIG. 20 is a sectional view of the threader bar assembly taken along the lines 20—20 in FIG. 19.
Figure 19:
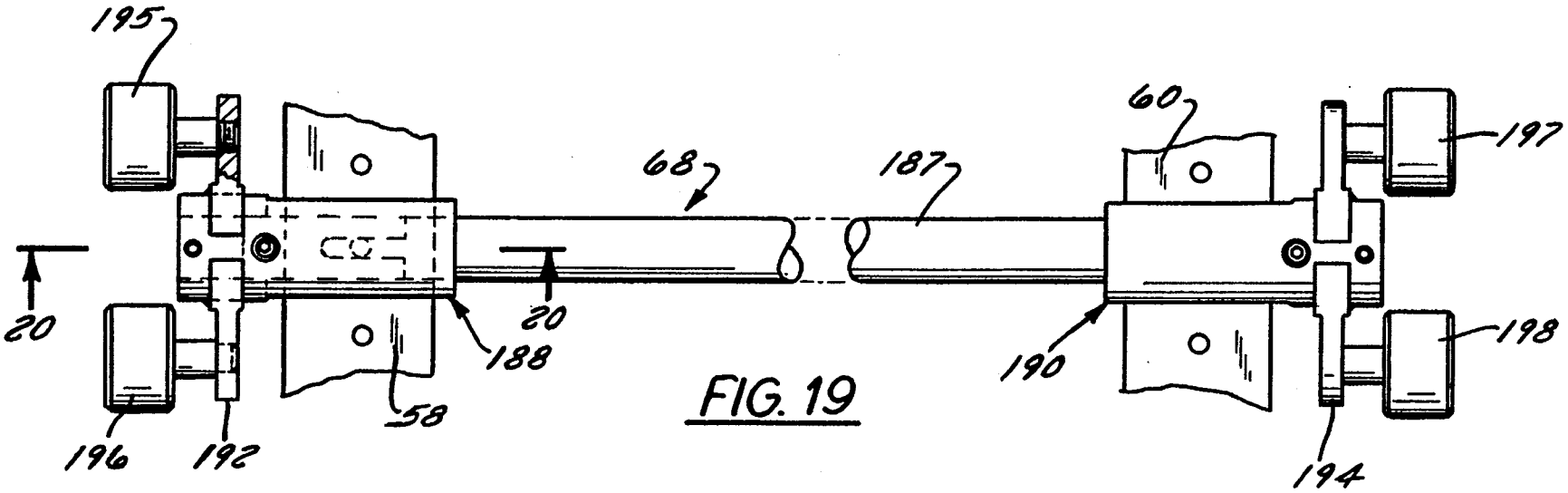
FIG. 19 is a top plan view of a threader bar assembly constructed in accordance with a first embodiment of the invention.

To this end, referring to FIGS. 19–21, the threader bar assembly 68 has opposed ends 188 and 190 which are connectable to respective belts 58 and 60 and which receive respective ends of a central rod 187 extending transversely to the web paths 41, 43. Each of the ends 188 and 190 extends laterally beyond the outer edge of the respective belt 58 and 60 and receives a support bar 192 and 194 extending parallel to the respective belt. Support rollers 195, 196 and 197, 198 are mounted on the opposed longitudinal ends of the support bars 192 and 194 and guide the threader bar assembly 68 as discussed in more detail below.

Each of the ends 188 and 190 of threader bar assembly 68 is of identical construction. Accordingly, only the left end 188 will be described with reference to FIGS. 19–21. End 188 includes a hollow cylinder 199 having slots 201 formed therein for the passage of belt 58 therethrough. Cylinder 199 receives an end 200 of rod 187 which is in turn formed from two semi-cylindrical segments 203 and 204. The lower segment 203 of end 200 is formed integral with the main body of the rod 187 and has a pin 202 attached thereto. This pin extends through one of the holes 70 formed in the belt 58 and is received in a slot 206 formed in the upper segment 204 of end 200. The segments 203 and 204 are biased away from the left end of cylinder 199 by a spring 208 to facilitate disassembly of the threader bar assembly 68. The upper segment 204 is held in place by a set screw 210 during operation of the threader assembly. The illustrated arrangement permits limited movement of the rod 187 and the belts 58 and 60 relative to the remainder of threader bar assembly 68 during operation of the threader assembly 30 while at the same time maintaining a secure connection of the threader bar assembly 68 to the belts 58 and 60. Because threader bar assembly 68 can be easily detached from belts 58 and 60, different attachments could be used in its place, if desired.

Operation of Threader Assembly

Figure 6:
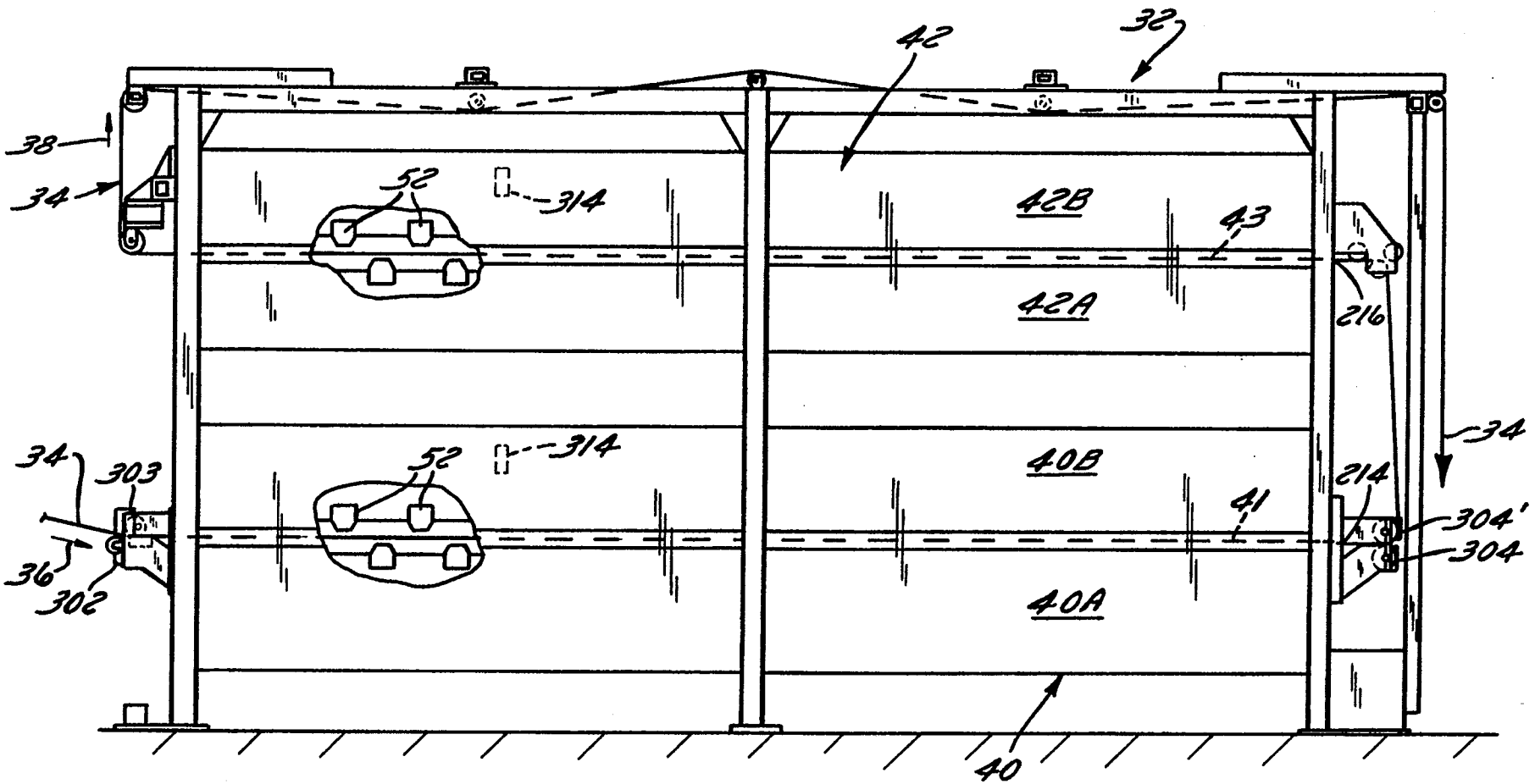
FIG. 6 illustrates the dryer of FIG. 5 with portions of the dryer being removed so as to illustrate the web.
Figure 8:
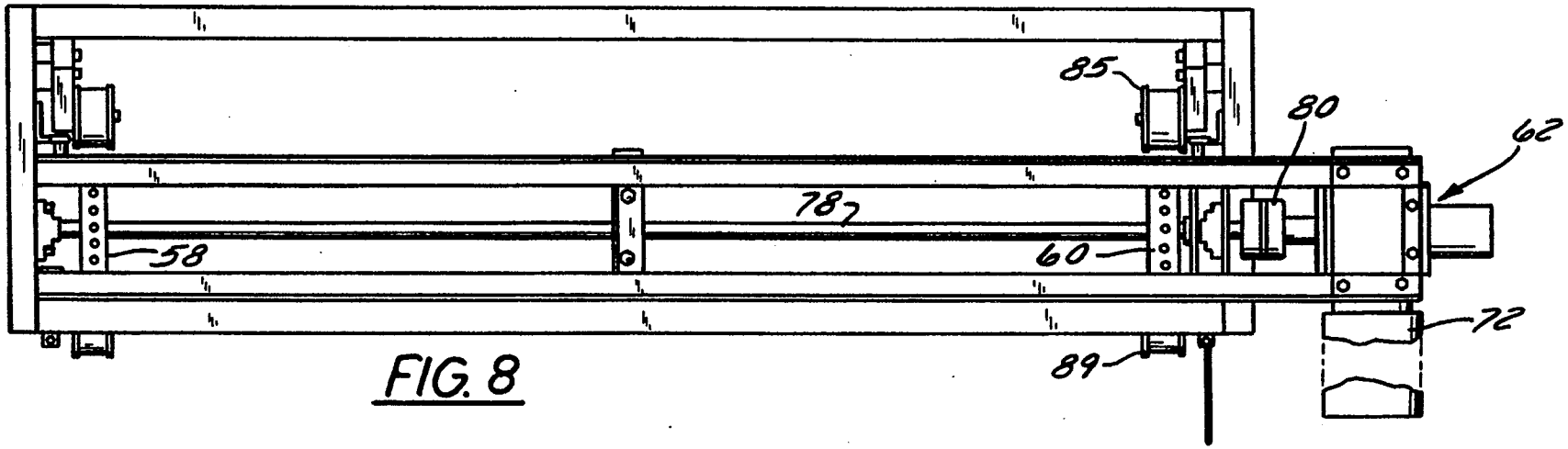
FIG. 8 is a top plan view of the drive system of FIG. 7.
Figure 7:
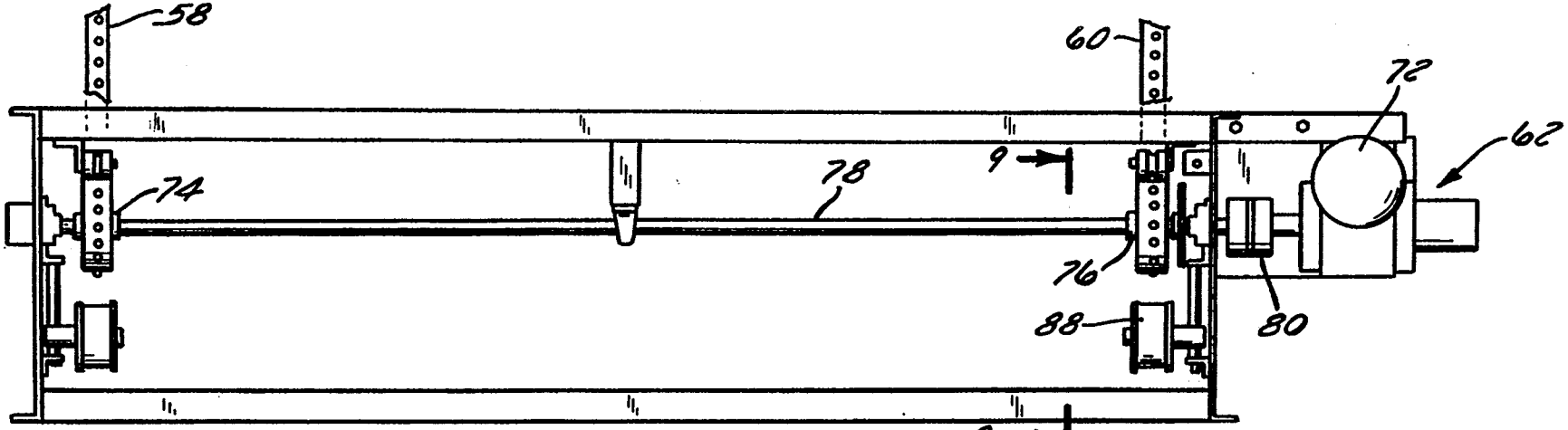
FIG. 7 is an elevation end view, taken along the line 7—7 in FIG. 5, of the drive system for the threader assembly of FIG. 1.
Figure 9:
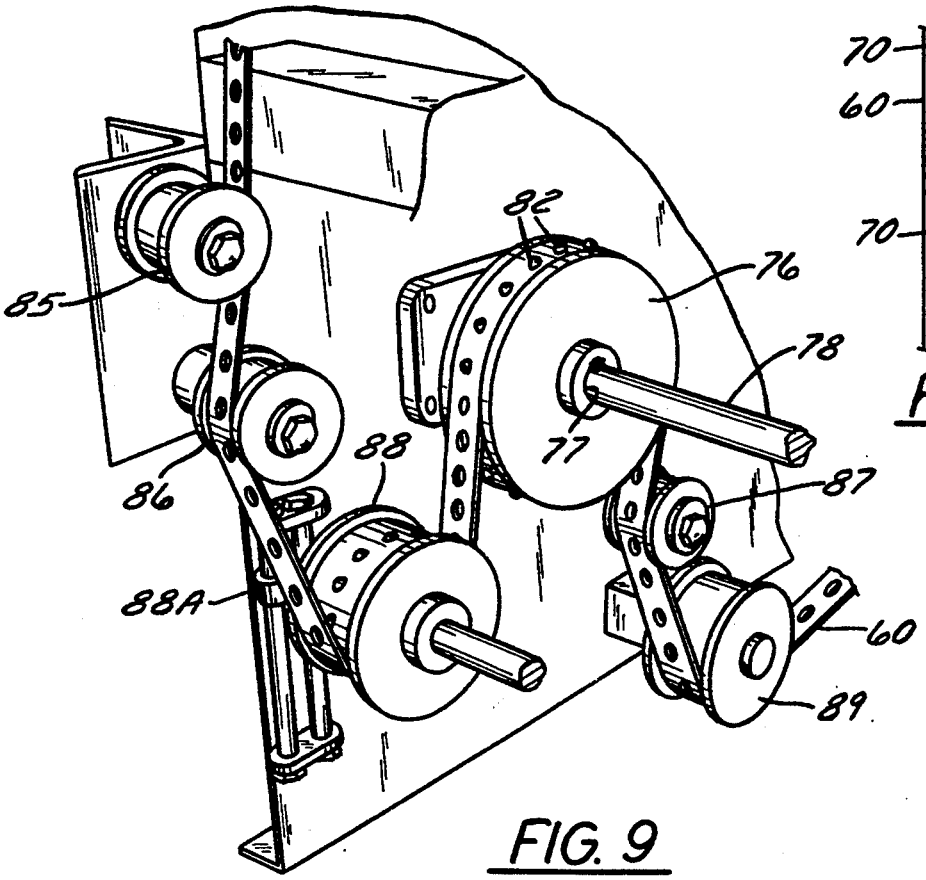
FIG. 9 is a sectional perspective view taken along the lines 9—9 in FIG. 7.
Figure 12:
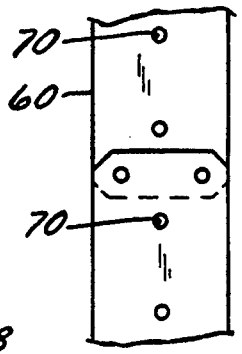
FIG. 12 is a plan view of a portion of the threader belt of FIG. 9.
Figure 10:
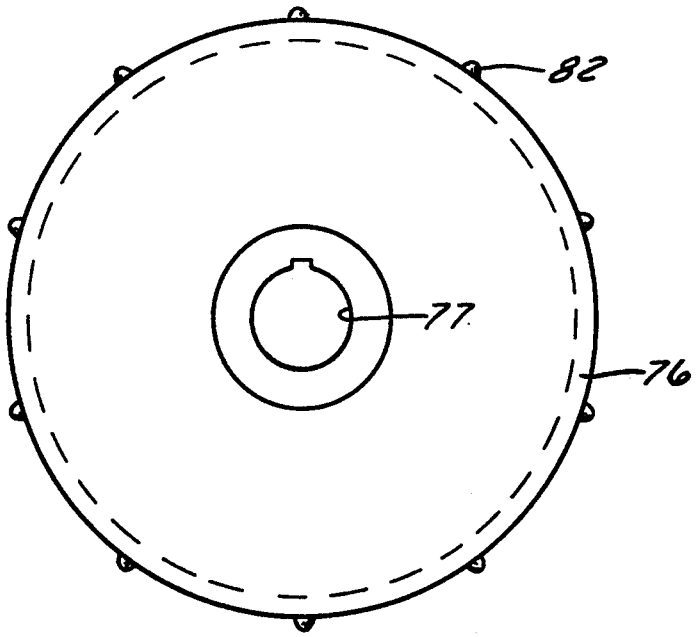
FIG. 10 is a side elevation view of the drive sprocket of the system illustrated in FIG. 9.
Figure 11:
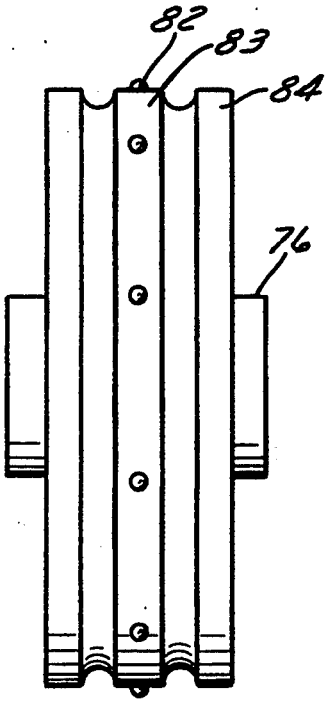
FIG. 11 is an elevation end view of the drive sprocket of FIGS. 9 and 10.

The web threader assembly 30 operates as follows. First, the drive system 62 is actuated to drive the belts 58 and 60 to position the threader bar assembly 68 in the position illustrated in FIG. 2. The leading edge 35 of the web 34 is then folded over itself and taped or otherwise affixed to the rod 187 of the threader bar assembly 68 as illustrated in FIG. 2. The wet face of the web 34 in this example is shown face down so that only its dry side contacts the roller 54. The web 34 is fed into the dryer inlet 44 at an angle as illustrated in FIGS. 3 and 6 in the direction of arrow 36 so as to prevent contact between the wet face of the web 34 and the plate 130. Lateral movement of the web is prevented by the belts 58 and 60 being held in position by flanged pulleys 100, 101, etc., and by the end rollers 195–198 of threader bar 68 riding on track 212.

The drive system 62 is then actuated to pull the leading edge 35 of web 34 through the inlet 44 of first dryer section 40, through the first dryer section, out of the outlet 214 of the first section 40, and is then turned upwards toward the second section 42 so that the now partially dried surface of the web faces upward. The web 34 is then threaded into the inlet 216 of second section through the second section, and out of the outlet 46 of second dryer section 42. The web then returns over the top of the upper section 42, and back down to the main floor where it is detached from the threader bar assembly 68 and fed to another device. Because belts 58 and 60 are extremely thin and thus take up little space within the dryer, operation of the threader assembly does not obstruct visually monitoring the equipment. Before and during these operations, guide frame 108 and a similar guide frame positioned adjacent the outlet 214 of dryer section 40, as well as internal retraction devices, will be selectively actuated to permit web threading while maintaining as much as possible the integrity of the entrance and exit seals.

It should be noted that while FIG. 2 illustrates the dryer section 40 as being opened during the web threading operation, this section should actually be closed to maintain the integrity of the inert atmosphere enclosure. Upper section 42 may be opened, if desired, since upper section 42 includes a more conventional ambient atmosphere.

As the belts 58 and 60 are conveyed over the various guide pulley assemblies 64, 68 and 87–100, the rollers 195–198 of threader bar assembly 68 are guided on the guide strips 156, 158–160, 168, and 182 which act as channel means for guiding the threader bar along the path of travel of the belts. The rollers 195–198 are guided within the dryer sections 40 and 42 by a track 212 formed on the support frame for air bars 52. It should be noted that during this motion, the web 34 does not contact the belts 58 and 60 but is instead pulled through the dryer only by threader bar 68 with its dry side guided on rollers such as the roller 54. The ink or other material on the wet face of the web thus is not smudged even during the threading operation. After the leading edge 35 of web 34 exits the outlet 46, it is guided over roll 56 (it should be noted that web 34 is dry at this point) and drawn upwardly in the direction of arrow 38 as illustrated in FIG. 6 over the top of section 42 and back down to the floor where it will be manually detached from threader bar 68 and fed into another device.

Due to the relative thinness of belts 58 and 60 the spacing between the roller 54 and the plate 130 is required only to be a little wider than the web 34, thus permitting effective sealing of the dryer. Sealing is further enhanced by nitrogen seals located at inlet and exit of the dryer. Although these seals are illustrated as being fixed to the dryer, they should be retractable to permit a web threading operation. The sequence of retraction and closure is discussed in more detail below in connection with the control system.

Description of Modified Threader Bar Assembly

Figure 23:
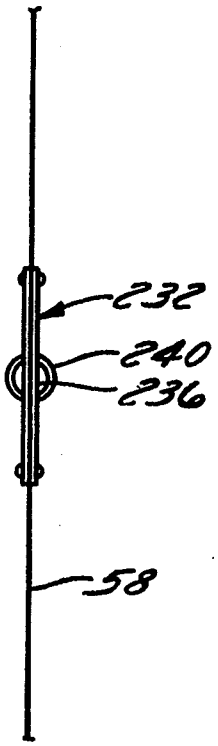
FIG. 23 is a side elevation view of the threader bar assembly of FIG. 22.
Figure 22:
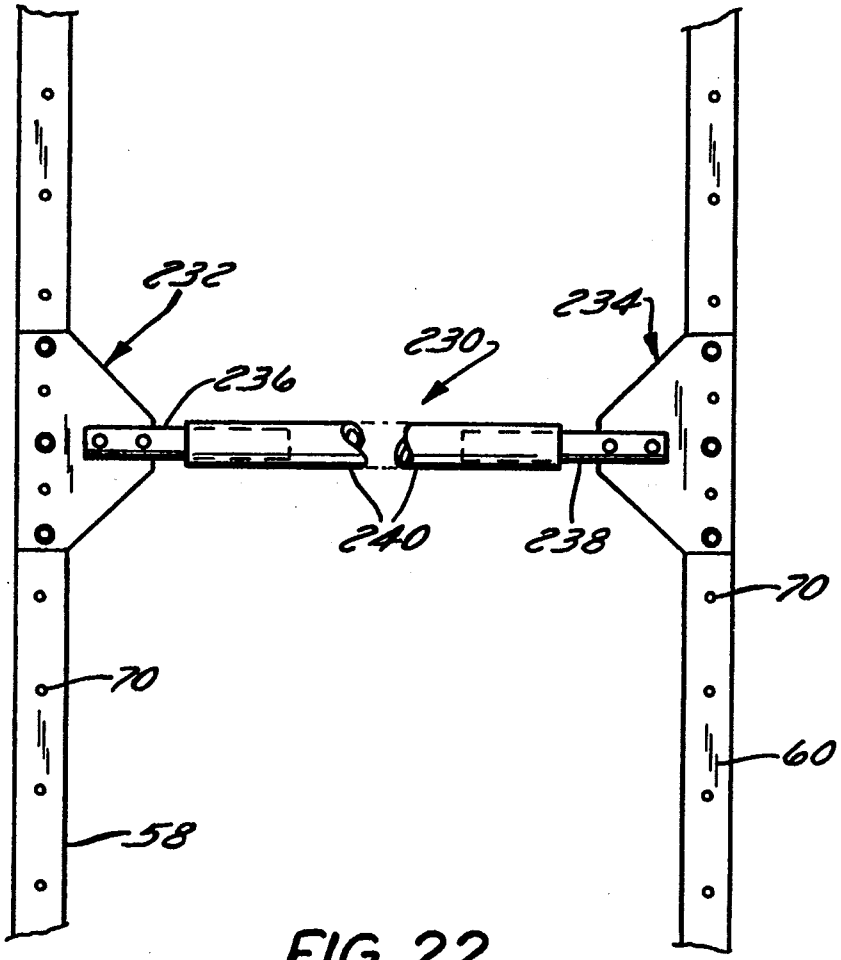
FIG. 22 is a top plan view of a threader bar assembly constructed in accordance with another embodiment of the present invention.
Figure 24:
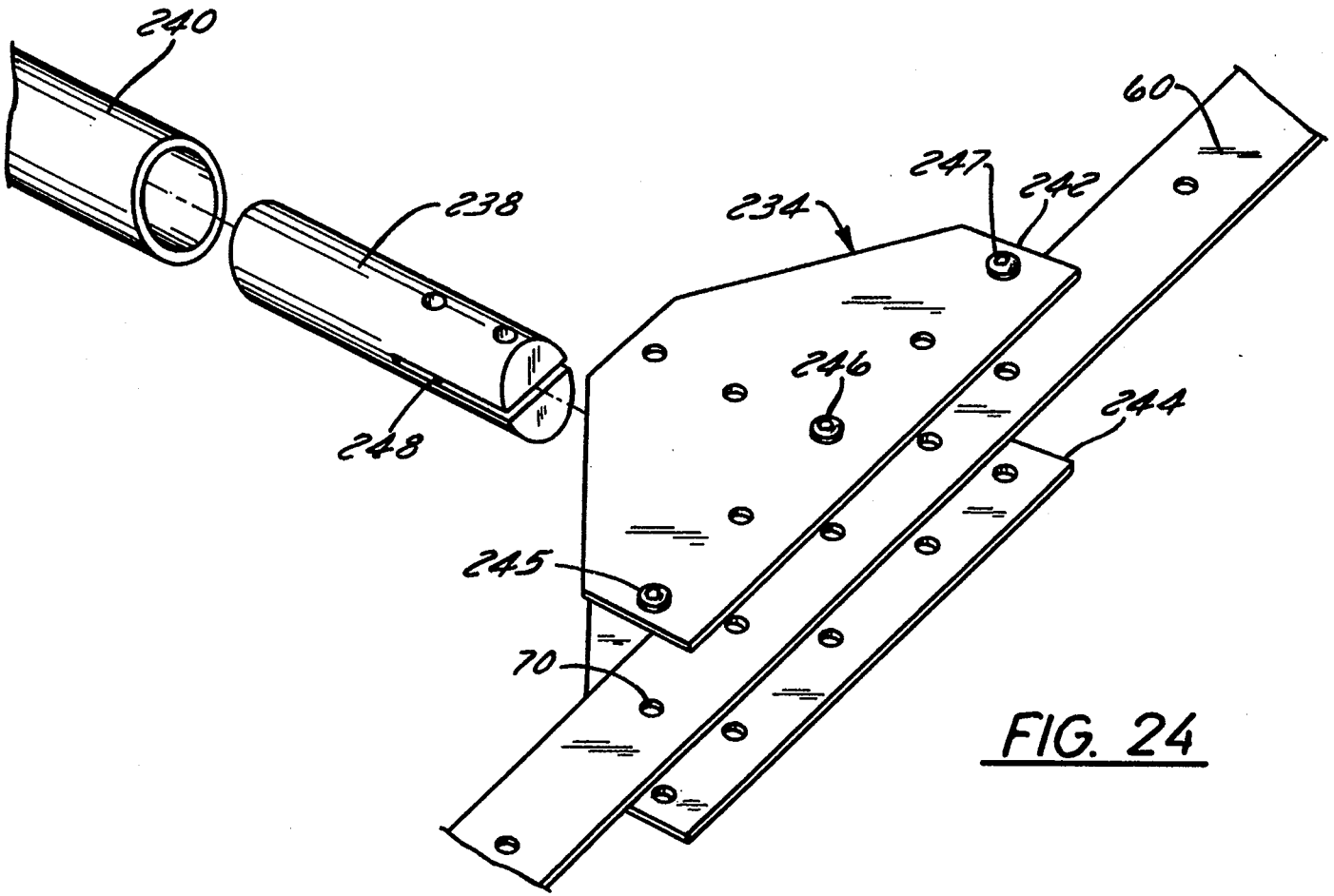
FIG. 24 is an exploded perspective view of a portion of the threader bar assembly of FIGS. 22 and 23.

Referring now to FIGS. 22–24, a simplified threader bar assembly 230 constructed in accordance with a modified form of the present invention can be used in applications where a detachable threader bar is not required. Threader bar assembly 230 includes generally triangular assemblies 232 and 234 bolted, riveted or otherwise detachably attached to the respective belts 58 and 60 of the threader assembly 30. Cantilevered rods 236 and 238 are attached to plate assemblies 232 and 234 and extend inwardly orthogonally to the belts 58 and 60 and are received in opposed ends of a central tube 240, which receives the leading edge of a web 34 as discussed above in connection with the central bar 187 of threader bar assembly 68. Tube 240 is preferably slightly shorter than the average distance between the plate assemblies 232 and 234 so as to permit limited relative movement between the tube 240 and the belts 58 and 60. Preferably, each of the triangular plate assemblies 232 and 234 includes two plates 242 and 244 (FIG. 24) which sandwich the respective belt therebetween, which are connected together by e.g. rivets 245–247, and which have inner lateral edges received in a slot 248 formed in the respective rod 236 or 238.

The threader bar assembly 230 lacks the guide rollers of the threader bar assembly 68 of the first embodiment of the invention and thus does not require the provision of guide elements such as the guide strips 158–160, 168, or 182. Accordingly, this threader bar assembly is simpler than the threader bar assembly 68 of the first embodiment of the invention. It is therefore ideally suited for applications where the threader bar can remain attached to belts 58 and 60. The construction and operation of the web threader 30 incorporating the threader bar assembly 230 is otherwise identical to a web threader assembly incorporating the threader bar assembly 68 of the invention. Further description of the modified web threader will thus be omitted to avoid undue repetition.

Description of Control System

Any of a wide variety of manual and/or electronic control systems could be used to control the operation of web threader assembly 30. It is, however, preferred that devices be provided to control the speed of the web threader assembly, to detect faults and, in certain instances, to override normal operation of the web threader upon detection of a fault.

Figure 5:
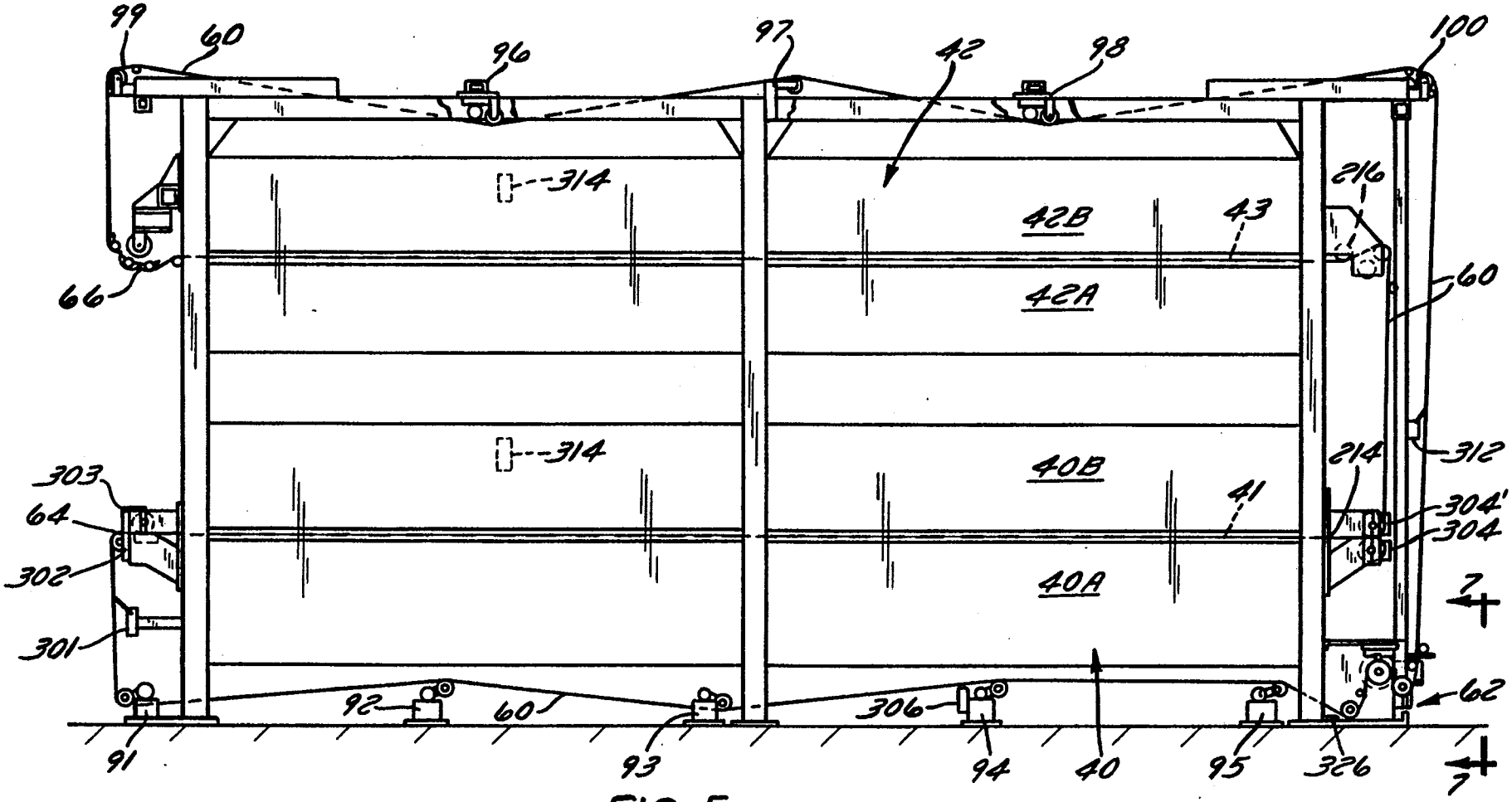
FIG. 5 is a partially cut-away side elevation view of the dryer of FIG. 1.
Figure 25:
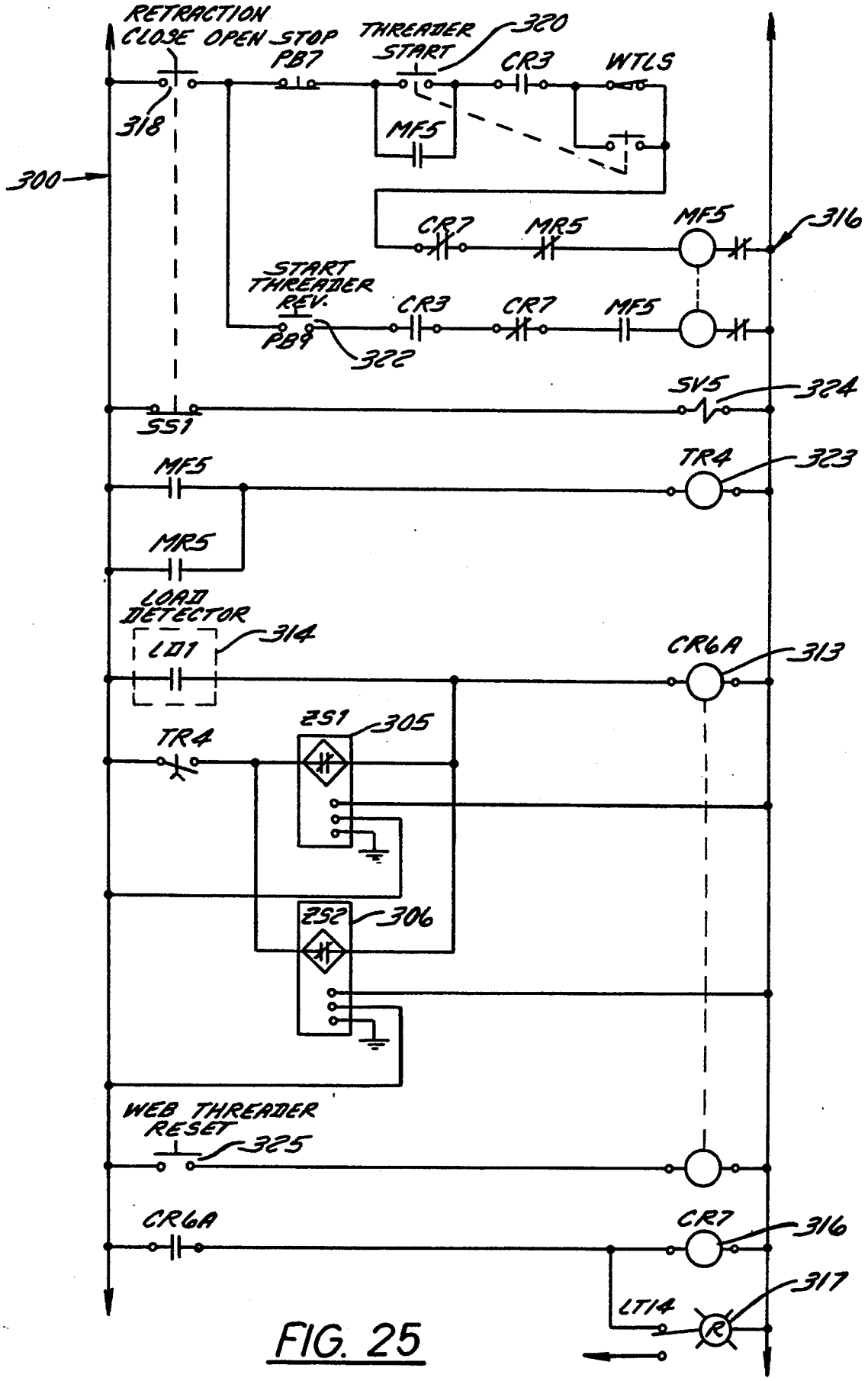
FIG. 25 schematically illustrates a control circuit for the threader assembly of FIGS. 1–18.

Referring now to FIGS. 5, 6, and 25, an exemplary electronic control system 300 for the web threader 30 is illustrated. Input devices for the control circuit 300 include a zero speed switch 305, 306 provided on each belt 58, 60, limit switches 302–304 provided adjacent the openings in the first dryer section 40, limit switches 301–304′ provided along the belt path, retraction switches 314 provided within the dryer sections 40 and 42, a limit switch 312 positioned outside of the dryer 30, a counter 326 provided adjacent one of the belts, and a plurality of manually operated switches (not shown in FIG. 5).

The switches and counter are wired into the control circuit 300 illustrated in FIG. 25 to perform the following functions. Referring to FIG. 25, a web threader starter circuit 316, including manually actuated starter and cylinder actuation buttons 318, 320, and 322, enables movement of the web 34 in either the forward or the reverse direction. Providing the threader reverse button 322 in this circuit permits the web to be backed up in case of a misfeed without destroying the web.

Zero speed switches 305 and 306 detect movement of the respective belts 58, 60. If the belt breaks or becomes extremely slack, the respective zero speed switch will detect such a condition and generate a signal used to cut off power to the motor 72 of drive system 62. A timer 323 disables the switches 305 and 306 for a predetermined amount of time after motor start-up so that the threader can build up speed, thus preventing the zero speed switches from erroneously indicating a system fault.

A load detector 314 is provided in the circuit of motor 72 and detects an increase in current drawn by the motor which occurs when the web threader becomes jammed for any reason. Load detector 314, as well as zero speed detecting switches 305 and 306, are connected to a latch relay 313 and to a warning light 317. Latch relay 318 cuts off power to the electric motor when any of the switches or detectors 305, 306, or 314 detects a fault and is reset only upon actuation of a manual reset button 325. Warning light 317 provides a visual indication of a system fault.

Detector 312 may comprise a limit switch, a photoeye, or any other device capable of detecting the presence of the threader bar assembly 68 or 230. For instance, detector 312 may comprise a limit switch which is located in series with the threader start button 320 and which cuts off power to the motor 72 when the presence of the threader bar 68 or 230 is detected. The retraction solenoid 324 operating internal retraction mechanisms for the air bars 52 and associated header assemblies is likewise deactivated upon detection of the threader bar, thus permitting the internal components of each dryer section 40, 42 to return to its operating position only after completion of a web threading operation.

The disclosed control circuit thus monitors operation of the threader assembly and deactivates the threader assembly upon detection of a fault. Although the circuit illustrated in FIG. 25 works independently from the external retraction assembly which opens dryer sections 42, these devices could also be opened automatically using limit switches and a counter and an appropriate analog or digital control system. However, the circuit illustrated in FIG. 25 can be employed as follows.

Counter 326 may monitor rotation of a pulley of the drive system 62 or may monitor the position of the belt in any other suitable manner. Limit switch 301 resets counter 326 to zero when it detects the presence of a threader bar adjacent inlet 64 of dryer section 40, at which point the controller actuates cylinders 114 and 116 (FIGS. 2 and 3) and the retraction solenoid 324 to pivot frame 108 and to raise the air bar assemblies to positions permitting web threading. The controller 300 restarts the drive systems only when limit switch 302 detects that the web seal is open and when switches 314 detect that the internal retraction assemblies have operated. After the counter 326 determines that the threader bar assembly has been conveyed into the dryer, web seals frame 108 is closed to maintain the integrity of the dryer seal. Closure of frame 108 is detected by switch 303. As the threader bar nears the end of the dryer, the counter 326 will instruct the controller to open the seals on exit end 214 of section 40, and will cause the controller to close these seals after the threader exits the exit end. Opening and closing of this seal is monitored by limit switches 304 and 304'.

Corresponding limit switches are not provided on upper section 42, which lacks web seals because it does not maintain an inert atmosphere. Retraction detection switches are provided, however. Of course, limit switches 302–304' should be provided if section 42 does include an inert atmosphere seals.

The control systems described above are merely representative of a variety of analog and/or digital control systems which could be used to monitor and control operation of the threader assembly 30 and of the dryer 32. For instance, other detectors could be used in addition to or in place of those shown and described. For instance, the zero speed switches could be replaced with limit switches on tensioners 90–95 which detect excessive tension in the belts (through excessive movement of roller 140 in the direction opposite to arrow 150 in FIG. 13). Other possible modifications to the control system, as well as possible modifications to the disclosed threader assembly, will become more readily apparent from a reading of the appended claims.

What is claimed is:

1. An apparatus comprising:

a. a machine having a web path;

b. an endless threader belt extending along said web path, said belt including (1) means for detachably receiving a leading edge of a continuous web and (2) a thin flexible metal strip having perforations evenly spaced along its length;

c. guide means for guiding said belt along said web path;

d. a sprocket having protrusions which engage said perforations; and e. driver means for driving said sprocket, said sprocket driving said belt through said driver along said web path and carrying said web therewith.

2. The apparatus as defined in claim 1, further comprising slack tensioner means, over which said belt is conveyed, for maintaining said belt taut.

3. The apparatus as defined in claim 1, further comprising sprocket friction means for maintaining said belt in contact with said sprocket.

4. An apparatus for threading a web through a dryer having a web path, said web having a leading edge, the apparatus comprising:

a. an endless threader belt extending along said web path, said belt including (1) means for detachably receiving said leading edge of said web and (2) a thin strip of flexible stainless steel having perforations evenly spaced along its length;

b. guide means for guiding said belt along said web path;

c. a sprocket having protrusions which engage said perforations; and d. driver means for driving said sprocket, said sprocket driving said belt through said dryer along said web path and carrying said web therewith; wherein said means for detachably receiving comprises a threader bar attached to said thin strip, said leading edge being attachable to said threader bar.

5. The apparatus as defined in claim 4, further comprising a web guide assembly, mounted proximate an outlet of said dryer, which guides said web out of said dryer.

6. The apparatus according to claim 5, wherein said threader bar has an end, and wherein said web guide assembly includes i. a plurality of pulleys which guide said belt through a path which curves out of said dryer, ii. a curved strip, mounted adjacent said pulleys, which guides said end of said threader bar along said curved path, and iii. a roller, located above said pulleys, which guides said web out of said outlet.

7. An apparatus as defined in claim 1, wherein said metal strip is composed of stainless steel.

8. An apparatus as defined in claim 1, wherein said machine comprises a dryer.

9. An apparatus for threading a web through a dryer having a web path, said web having a leading edge, the apparatus comprising:

a. an endless threader belt extending along said web path, said belt comprised of a thin strip of a flexible metal having perforations evenly spaced along its length;

b. a threader bar detachably attached to said belt, said leading edge being detachably affixable to said bar, said threader bar having ends;

c. a sprocket having protrusions which engage said perforations;

d. driver means for turning said sprocket, said sprocket driving said belt and said threader bar through said dryer along said web path and carrying said web therewith; and e. guide means, located along said web path, for guiding said belt along said web path.

10. The apparatus as defined in claim 9, wherein said threader bar has ends, and further comprising channel means for guiding said threader bar along said web path, said channel means engaging said ends of said threader bar.

11. The apparatus as defined in claim 10, wherein said ends comprise rollers which roll on said channel means.

12. The apparatus as defined in claim 11, wherein each of said ends further comprises a hollow tube which is slitted to receive said belt and a segmented shaft at least partially disposed in said hollow tube, said segmented shaft comprising first and second sections which receive said belt therebetween, each of said ends further comprising a pin which extends from said first section, through one of said perforations in said belt, and into said second section.

13. The apparatus as defined in claim 11, wherein said threader bar includes a pair of plates, each of which is attached to one of said belts, and a rod connecting said plates to one another.

14. The apparatus as defined in claim 9, wherein said guide means comprise pulleys adapted to be spaced along said web path outside of said dryer.

15. The apparatus as defined in claim 9, further comprising idler pulleys which are located on either side of said sprocket and which apply sufficient tensioning forces to said belt to permit said sprocket to drive said belt in both forward and reverse directions.

16. An apparatus as defined in claim 9, wherein said belt is composed of stainless steel.

17. An apparatus for threading a web, having a leading edge, through a dryer, said dryer having an inlet and an outlet, two sides, and a web path extending between said sides through said dryer, the apparatus comprising:

a. two endless threader belts, each said belt extending along a respective said side and through said web path and comprised of a thin strip of a flexible metal having perforations evenly spaced along its length;

b. a threader bar having ends and extending between said sides, said threader bar positioned transversely to said web path and detachably affixable to each said belt, said leading edge attachable to said threader bar;

c. sprockets having protrusions which engage each said belt;

d. driver means for turning said sprockets at equal speeds, said sprockets driving each said belt at equal speeds through said dryer along said web paths and carrying said web therewith;

e. guide means, spaced along each said belt, for guiding each said belt; and f. channel means for guiding said ends and guiding said threader bar along said web path.

18. The apparatus as defined in claim 17, wherein said guide means comprises flanged pulleys.

19. The apparatus as defined in claim 17, wherein said channel means comprises metal strips.

20. An apparatus as defined in claim 17, wherein said belt is composed of stainless steel.

21. A dryer comprising a. an inlet;

b. an outlet c. two sides;

d. a web path extending between said sides and inside said dryer from said inlet to said outlet;

e. a plurality of air bars positioned above and below said web path;

f. a threader assembly for threading a web, having a leading edge, through said dryer, said threader assembly including i. two endless threader belts, each said belt extending along a respective side of said web path and comprised of a thin strip of flexible stainless steel having perforations evenly spaced along its length, ii. a threader bar having ends and extending between said sides, said threader bar positioned transversely to said web path and detachably affixed to each said belt, said leading edge attached to said threader bar, iii. sprockets having protrusions which engage each said belt, iv. a drive system including a motor and a shaft which is connected to said motor and to said sprockets and which turns said sprockets at equal speeds such that said sprockets drive each said belt at equal speeds through said dryer along said web path and carry said web therewith;

v. flanged pulleys, mounted on said sides and spaced along each said belt, which guide each said belt, vi. metal strips, located along each said side, which guide said ends of said threader bar along said web path, vii. web guide assemblies, mounted at the outlet along each said side, each of said web guide assemblies including (1) a plurality of pulleys which guide one of said belts through a path which curves out of said dryer, (2) a curved strip, mounted adjacent said pulleys, which guides one of said ends of said threader bar along said curved path, and (3) a roller, located above said pulleys, which guides said web out of said outlet and away from said belts; and an electronic control device which automatically controls the operation of said web threader.

22. The dryer as defined in claim 21, wherein said dryer comprises a first, stationary portion and a second portion which is positioned on top of said first portion so as to permit sealing of said first and second portions and which is raisable from a first position in which said second portion is in close proximity to said first portion to a second position in which said second portion is spaced from said first portion.

23. The dryer as defined in claim 22, and further comprising a plurality of seals which seal said second portion with respect to said first portion when said second portion is in said first position.

24. The dryer as defined in claim 23, wherein said dryer comprises first and second sections stacked one on top of the other, said first and second portions forming said first section, said second section comprising a first, stationary portion and a second portion which is positioned on top of said first portion and which is raisable from a first position in which said second portion is in close proximity to said first portion to a second position in which said second portion of said second section is spaced from said first portion.

25. An apparatus comprising a. a machine having a web path;

b. a web threader for threading a continuous web through said machine along said web path, said web having a leading edge, the web threader including i. an endless threader belt extending along said web path, said belt comprised of a thin strip of flexible metal and having means for detachably receiving a leading edge of said web;

ii. a drive device which drives said belt through said machine along said web path and which carries said web therewith; and iii. guides which guide said belt along said web path and which keep said belt taut.

26. An apparatus as defined in claim 25, wherein said belt is composed of stainless steel.

27. An apparatus for threading a web through a machine having a web path, said web having a leading edge, the apparatus comprising:

a. an endless threader belt extending along said web path, said belt comprised of a thin strip of flexible metal;

b. a drive device which drives said belt through said machine along said web path and which carries said web therewith; and c. guides which guide said belt along said web path and which keep said belt taut, wherein said belt is provided adjacent a first side of said web path, and further comprising d. a second belt provided adjacent a second side of said web path; and e. a threader bar having first and second ends attached to said first and second belts, said threader bar detachably receiving said leading edge of said web.

28. The apparatus as defined in claim 27, wherein said threader bar has rollers provided on said first and second ends thereof, and further comprising guide elements which engage said rollers and which guide said threader bar along said web path.

29. The apparatus as defined in claim 26, wherein said belt has perforations formed therethrough, and wherein said drive device includes a sprocket having protrusions which engage said perforations in said belt.

30. The apparatus as defined in claim 29, further comprising idler pulleys which are located on either side of said sprocket and which apply sufficient tensioning forces to said belt to permit said sprocket to drive said belt in both forward and reverse directions.

31. An apparatus as defined in claim 25, wherein said machine comprises a dryer.

* * * * *